US012215492B2

(12) United States Patent
Matsunaka et al.

(10) Patent No.: US 12,215,492 B2
(45) Date of Patent: Feb. 4, 2025

(54) FLUSH TOILET

(71) Applicant: TOTO LTD., Kitakyushu (JP)

(72) Inventors: Satoshi Matsunaka, Kitakyushu (JP); Kenji Watanabe, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 923 days.

(21) Appl. No.: 17/333,112

(22) Filed: May 28, 2021

(65) Prior Publication Data

US 2021/0372108 A1 Dec. 2, 2021

(30) Foreign Application Priority Data

Jun. 2, 2020 (JP) ..... 2020-096002

(51) Int. Cl.
*E03D 1/012* (2006.01)
*E03D 1/28* (2006.01)
*E03D 5/01* (2006.01)

(52) U.S. Cl.
CPC ..... *E03D 1/0125* (2013.01); *E03D 1/28* (2013.01); *E03D 5/01* (2013.01)

(58) Field of Classification Search
CPC ..... E03D 1/0125; E03D 1/28; E03D 5/01
USPC ..... 4/332
See application file for complete search history.

(56) References Cited

U.S. PATENT DOCUMENTS 11,339,559 B2 * 5/2022 Iwaki ..... E03D 9/00
11,414,850 B2 * 8/2022 Tone ..... E03D 5/01
11,486,123 B2 * 11/2022 Tone ..... E03D 1/30
11,566,410 B2 * 1/2023 Eto ..... E03D 11/13
2004/0068785 A1 4/2004 Tomita et al.
2017/0350108 A1 * 12/2017 Harashima ..... E03D 5/01
2021/0108403 A1 * 4/2021 Kato ..... E03D 11/13
2022/0275620 A1 * 9/2022 Maruyama ..... E03D 5/10

FOREIGN PATENT DOCUMENTS

JP 2001-348937 A 12/2001
JP 2006-057453 A 3/2006
JP 2017066673 A * 4/2017
JP 2019-173315 A 10/2019

OTHER PUBLICATIONS

JP-2017066673-A Machine Translation (Year: 2024).*
Notice of Reasons for Refusal issued in Japanese Patent Application No. 2020-096002, dated Sep. 5, 2022, with English Translation.

* cited by examiner

*Primary Examiner* — Erin Deery
*Assistant Examiner* — William R Klotz
(74) *Attorney, Agent, or Firm* — BakerHostetler

(57) ABSTRACT

A flush toilet includes a toilet main body and a tank device for supplying flush water to the toilet main body, where the tank device includes a storage tank provided behind the toilet main body and above a floor surface, the storage tank includes a large tank section and a small tank section and has an asymmetrical shape in a front-back or left-right direction, the large tank section being a large-capacity side of the storage tank that is divided into two at a center in the left-right direction when seen in the front-back direction, the small tank section being a small-capacity side of the storage tank that is divided into two at the center in the left-right direction, and the storage tank or the toilet main body includes a deformation-preventing supporting member for preventing deformation of the storage tank by supporting the storage tank.

9 Claims, 16 Drawing Sheets

FLUSH TOILET

CROSS REFERENCE TO RELATED APPLICATION

This application claims benefit of priority to Japanese Patent Application No. 2020-096002, filed on Jun. 2, 2020, the entire content of which is incorporated herein by reference.

FIELD OF THE INVENTION

The present invention relates to a flush toilet, and more particularly, to a flush toilet for discharging waste with flush water.

BACKGROUND OF THE INVENTION

Conventionally, as flush toilets for discharging waste with flush water, those including a toilet flushing mechanism for enabling flushing of a toilet main body, and a private part washing mechanism for washing a private part of a toilet user are known, as disclosed in Patent Document 1 (Japanese Patent Laid-Open No. 2001-348937) and Patent Document 2 (Japanese Patent Laid-Open No. 2006-057453). With such conventional flush toilets, the toilet flushing mechanism and the private part washing mechanism are assembled on a rear side of the toilet main body, and thus, there is a problem of how to achieve a "low silhouette" where an upper end height of the entire flush toilet is reduced as much as possible to meet recent demands of improving and diversifying the design of flush toilets.

Accordingly, some conventional flush toilets as described above adopt a toilet flushing mechanism that is directly connected to a water pipe for supplying flush water from outside and that allows flush water to be discharged by opening/closing of a valve so that a storage tank for storing flush water for flushing the toilet becomes unnecessary and the size of the entire toilet flushing mechanism is reduced.

In the case where the conventional flush toilet as described above adopts a storage tank as a part of the toilet flushing mechanism, there is a problem of how to secure an appropriate capacity of the storage tank that enables flushing of the toilet while achieving a low-silhouette toilet. Furthermore, recent improvement and diversification of the design of flush toilets lead to a problem of how to reduce a forward protruding dimension and a height dimension of the flush toilet while securing a storage tank capacity by effectively using a limited installation space behind the toilet main body. For example, in relation to the storage tank, there is a problem that there are many restrictions regarding design of the storage tank; for example, the storage tank has to be formed into a complex distorted shape or a relative position of the storage tank to the toilet main body has to be modified such that the storage tank does not obstruct a discharge trap and the like when installed behind the toilet main body. When the storage tank is designed to have a complex distorted shape, the storage tank is possibly formed into an unbalanced shape that is highly asymmetrical with respect to a center of gravity of the storage tank and is possibly easily deformed when installed on the toilet main body, and there is a problem that a design error is possibly caused due to permanent deformation or the like. Furthermore, in a case where the storage tank itself includes a joining portion that is joined in a watertight manner in a state where the storage tank is installed on the toilet main body, or in a case where there is a connection element that is connected to the storage tank in a watertight manner, if the storage tank is deformed at the joining portion or a connection part to the connection element, flush water in the storage tank is possibly leaked, and reliability of a tank device or the flush toilet is reduced. Accordingly, in recent years, there are demands regarding how to prevent deformation of a storage tank that is installed on a toilet main body, and how to secure reliability of a tank device.

The present invention has been made in view of the problems of the conventional art and recent demands as described above, and is aimed at providing a flush toilet with which deformation of a storage tank that is installed on a toilet main body can be prevented and reliability of a tank device can be secured.

SUMMARY OF THE INVENTION

To solve the problems described above, the present invention is a flush toilet for discharging waste with flush water, the flush toilet including: a toilet main body including a bowl configured to receive waste, and a discharge trap configured to discharge the waste in the bowl; and a tank device configured to supply the flush water to the toilet main body, where the tank device includes a storage tank configured to store the flush water to be supplied to the toilet main body, the storage tank being provided behind the toilet main body and above a floor surface, the storage tank has a shape that is asymmetrical in a front-back or left-right direction and includes a large tank section and a small tank section, the large tank section being a large-capacity side of the storage tank that is divided into two at a center in the left-right direction when seen in the front-back direction, the small tank section being a small-capacity side of the storage tank that is divided into two at the center in the left-right direction when seen in the front-back direction, and the storage tank or the toilet main body includes a deformation-preventing supporting member configured to prevent deformation of the storage tank by supporting the storage tank that is installed on the toilet main body. According to the present invention configured in the above manner, because the shape of the storage tank is made asymmetrical in the front-back or left-right direction by the large tank section and the small tank section, in a state where the storage tank of the tank device is installed behind the toilet main body and above the floor surface, the storage tank is easily deformable due to the weight of the flush water stored in the storage tank. However, in the present invention, deformation of the storage tank may be prevented by supporting the storage tank that is installed on the toilet main body, by the deformation-preventing supporting member provided at the storage tank or the toilet main body. Accordingly, for example, even when the storage tank itself includes a joining portion to be joined in a watertight manner in a state where the storage tank is installed on the toilet main body, or a connection element to be connected to the storage tank in a watertight manner is included, leakage of flush water in the storage tank that is caused by deformation of the joining portion of the storage tank or a connection part to the connection element may be prevented. As a result, reliability of the tank device may be secured.

In the present invention, preferably, the storage tank includes a supported portion configured to be supported by the deformation-preventing supporting member, the supported portion being positioned at a position not coinciding with a position of a center of gravity of the storage tank. According to the present invention configured in the above manner, even when the storage tank that is installed on the toilet main body is in a state where the storage tank is easily deformable due to balance being unstable around the center of gravity due to the shape of the storage tank being asymmetrical in the front-back or left-right direction, the supported portion of the storage tank that is supported by the deformation-preventing supporting member is at a position not coinciding with the position of the center of gravity of the storage tank, and thus, deformation of the storage tank may be effectively prevented.

In the present invention, preferably, the supported portion of the storage tank includes a first supported portion and a second supported portion positioned on either side of the position of the center of gravity of the storage tank in the front-back direction or the left-right direction, and the deformation-preventing supporting member includes a first supporting portion and a second supporting portion configured to be fixed to the first supported portion and the second supported portion, respectively, the first supporting portion and the second supporting portion being positioned on the either side of the position of the center of gravity of the storage tank in the front-back direction or the left-right direction. According to the present invention configured in the above manner, the first supporting portion and the second supporting portion of the deformation-preventing supporting member are capable of fixing the first supported portion and the second supported portion, respectively, the first supported portion and the second supported portion being positioned on the either side of the position of the center of gravity of the storage tank in the front-back or left-right direction. Accordingly, even in a case where deformation is easily caused due to the balance of the storage tank that is installed on the toilet main body being unstable around the center of gravity due to the shape of the storage tank being asymmetrical in the front-back or left-right direction, deformation of the storage tank may be more effectively prevented.

In the present invention, preferably, the storage tank includes a concave region formed into a concave shape by being surrounded by an inner side wall surface of each of the large tank section and the small tank section, and the deformation-preventing supporting member supports the supported portion to prevent deformation of the concave region of the storage tank. According to the present invention configured in the above manner, due to the demand to reduce the size while maintaining an amount of flush water to be stored, the storage tank to be installed in a limited space behind the toilet main body has a shape that is asymmetrical in the front-back or left-right direction. Furthermore, particularly, the concave region of the storage tank that is formed into a concave shape by being surrounded by the inner side wall surfaces of the large tank section and the small tank section of the storage tank complicates the shape of the storage tank, and is also easily deformed in a state where the storage tank is installed on the toilet main body. Accordingly, in the present invention, deformation of the concave region of the storage tank that has a complex shape and that is easily deformed may be effectively prevented by supporting the supported portion of the storage tank by the deformation-preventing supporting member. As a result, reduction in size may be achieved while securing a great capacity in relation to the storage tank. Furthermore, water leakage from the storage tank may be prevented, and reliability of the tank device may be secured.

In the present invention, preferably, at least a part of the supported portion is disposed in the concave region of the storage tank, and the deformation-preventing supporting member supports the supported portion while being at least partially disposed in the concave region of the storage tank. According to the present invention configured in the above manner, at least a part of the supported portion of the storage tank may be positioned in the concave region of the storage tank, and also, at least a part of the deformation-preventing supporting member may support the supported portion of the storage tank while being disposed in the concave region of the storage tank. Accordingly, deformation of the storage tank that is installed on the toilet main body may be efficiently prevented, and also, reduction in size may be achieved while securing a great capacity in relation to the storage tank. As a result, the size of the entire tank device may be reduced while securing reliability of the tank device, and also, the size of the entire flush toilet may be reduced.

In the present invention, preferably, the tank device further includes a pump configured to feed, under pressure, the flush water in the storage tank to the toilet main body, the pump being provided as the deformation-preventing supporting member. According to the present invention configured in the above manner, the pump of the tank device for feeding, under pressure, the flush water in the storage tank to the toilet main body may also be used as the deformation-preventing supporting member, and thus, a deformation-preventing supporting member other than the pump does not have to be provided, and the size of the entire tank device may be reduced. Accordingly, the size of the entire flush toilet may also be reduced.

In the present invention, preferably, there is further included an antivibration member provided between the storage tank and the toilet main body, where the pump is directly fixed to the storage tank, and the storage tank is fixed to the toilet main body via the antivibration member. The pump that feeds, under pressure, the flush water in the storage tank to the toilet main body generally causes vibration at the time of operation, and thus, according to the present invention configured in the above manner, the antivibration member or the like is desirably provided at a fixing part between the pump and the storage tank at the time of fixing the pump to the storage tank. However, in the case where the antivibration member or the like is provided at the fixing part between the pump and the storage tank in the manner described above, the pump is possibly prevented from functioning as the deformation-preventing supporting member by being obstructed by the antivibration member or the like at the time of the storage tank that is installed on the toilet main body deforming under the weight of the flush water in the storage tank. Accordingly, in the present invention, the pump is directly fixed to the storage tank, and the storage tank is fixed to the toilet main body via the antivibration member, and thus, transmission, between the tank device and the toilet main body, of vibration caused by the pump may be effectively prevented by the antivibration member between the storage tank and the toilet main body, while preventing deformation of the storage tank that is installed on the toilet main body.

In the present invention, preferably, the pump includes a pump chamber including an impeller, and a connecting pipe extending in the left-right direction of the storage tank from the pump chamber toward an upstream side to be connected to the storage tank, the connecting pipe being formed, as the deformation-preventing supporting member, from a material having higher rigidity than a flexible hose member. According to the present invention configured in the above manner, for example, if a flexible hose member is used as the connecting pipe for connecting the pump chamber of the pump and the storage tank, a winding space that takes into account flexibility of the flexible hose member becomes necessary around the pump and the storage tank. However, in the present invention, the connecting pipe is formed from a material having higher rigidity than a flexible hose member, and thus, a space around the pump and the storage tank for winding the connecting pipe becomes unnecessary. Accordingly, the tank capacity of the storage tank may be increased to that extent, and also, the size of the entire tank device may be reduced. Furthermore, the size of the entire flush toilet may also be reduced. Furthermore, because the connecting pipe of the pump has higher rigidity than a flexible hose member, vibration, deformation (elastic deformation such as bending, twisting, and warping) and the like of the connecting pipe itself at the time of operation of the pump may also be prevented. Accordingly, deformation of the storage tank that is installed on the toilet main body may be prevented without separately providing a deformation-preventing supporting member other than the pump. Moreover, the connecting pipe of the pump extends in the left-right direction of the storage tank from the pump chamber toward the upstream side to be connected to the storage tank, and thus, a forward protruding dimension of the tank device may be reduced, and a forward protruding dimension of the entire flush toilet may also be reduced. As a result, the size of the entire tank device and the entire flush toilet may be reduced while securing a large capacity in relation to the storage tank.

In the present invention, preferably, a discharge trap of the toilet main body extends in the front-back direction in a plan view, from an inlet connected to the bowl to an outlet behind the bowl, and the storage tank is disposed to surround an upper part of the discharge trap from both left and right sides and from a rear side. According to the present invention configured in the above manner, the discharge trap of the toilet main body extends in the front-back direction, in a plan view, from the inlet connected to the bowl to the outlet behind the bowl, and the storage tank may be disposed to surround the upper part of the discharge trap from both left and right sides and from the rear side. Accordingly, the storage tank and the pump may be efficiently disposed next to each other by effectively using the limited space around the upper part of the discharge trap behind the toilet main body. Accordingly, the forward protruding dimension of the tank device may be reduced and the forward protruding dimension of the entire flush toilet may also be reduced, and the size of the entire flush toilet may be reduced while increasing the capacity of the storage tank.

In the present invention, preferably, the storage tank includes a top tank section and a bottom tank section configured to be joined to each other in an up-down direction, and a supported portion configured to be supported by the deformation-preventing supporting member is provided at least at the top tank section of the top tank section and the bottom tank section, where a greater number of supported portions are provided at the top tank section than at the bottom tank section. According to the present invention configured in the above manner, in relation to the supported portion of the storage tank to be supported by the deformation-preventing supporting member, a great number of supported portions may be provided at least at the top tank section of the top tank section and the bottom tank section that are joined to each other in the up-down direction. Accordingly, the supported portion of the storage tank to be supported by the deformation-preventing supporting member may be concentrated on the top tank section side of the storage tank as much as possible. Therefore, when the supported portion of the storage tank is supported by the deformation-preventing supporting member after the storage tank is assembled to the toilet main body, deformation of the top tank section of the storage tank may be especially effectively prevented. Accordingly, deformation of the bottom tank section joined to the top tank section of the storage tank may also be effectively prevented, and deformation of the entire storage tank may be effectively prevented. Furthermore, the bottom tank section may stably support the weight of the flush water from below regardless of the amount of flush water in the storage tank, and is thus less likely to be deformed compared to the top tank section. In contrast, because the position of the center of gravity of the storage tank changes depending on the amount of flush water in the storage tank, the top tank section is more easily affected by the change in the position of the center of gravity of the storage tank than the bottom tank section, and is more easily deformed. Accordingly, because the storage tank may be stably supported by the deformation-preventing supporting member when a greater number of supported portions of the storage tank are provided at the top tank section than at the bottom tank section, deformation of the storage tank may be more effectively prevented. Furthermore, when a greater number of supported portions of the storage tank are provided at the top tank section than at the bottom tank section, a space below the bottom tank section may be effectively used, and the size of the entire flush toilet may be reduced, and a low silhouette may be achieved.

With the flush toilet of the present invention, deformation of the storage tank that is installed on the toilet main body can be prevented, and reliability of the tank device can be secured.

DETAILED DESCRIPTION OF THE PREFERRED EMBODIMENTS

Figure 1:
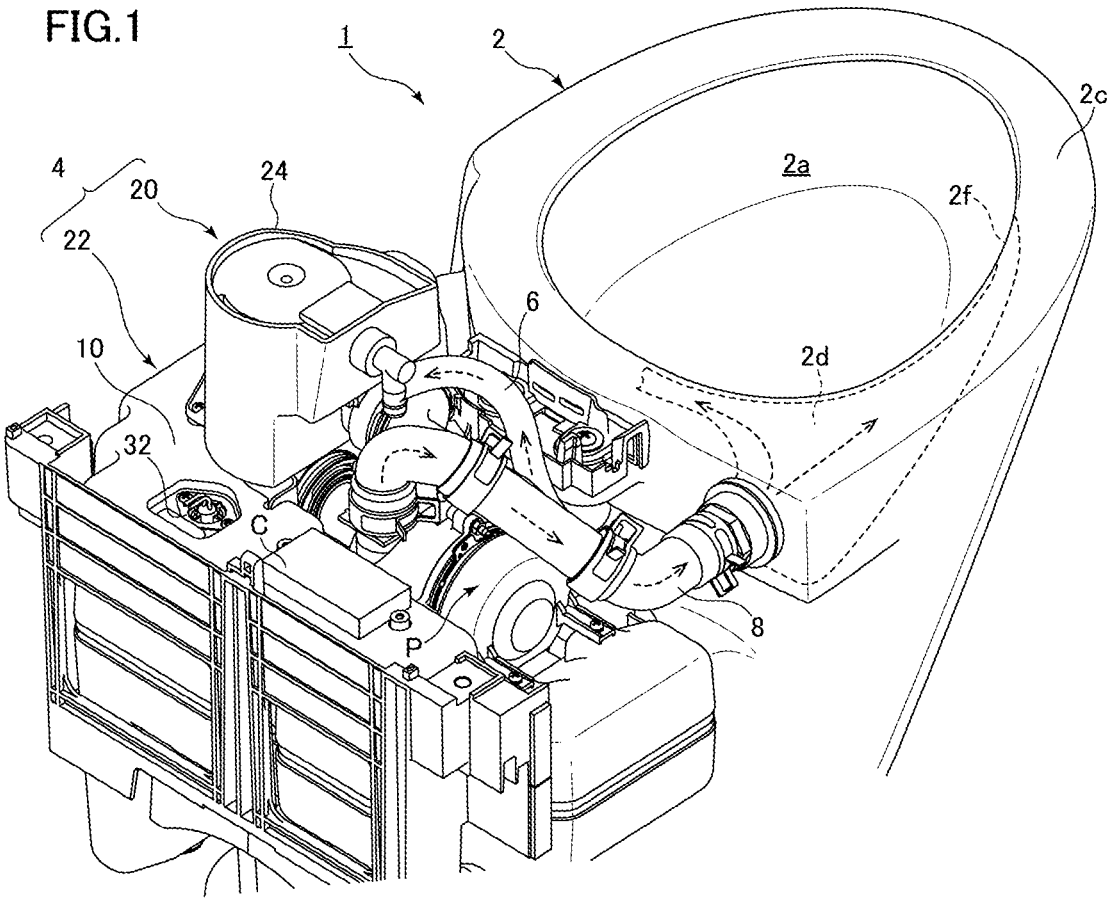
FIG. 1 is a schematic perspective view showing a flush toilet according to a first embodiment of the present invention, where the flush toilet is seen obliquely from behind and above.
Figure 2:
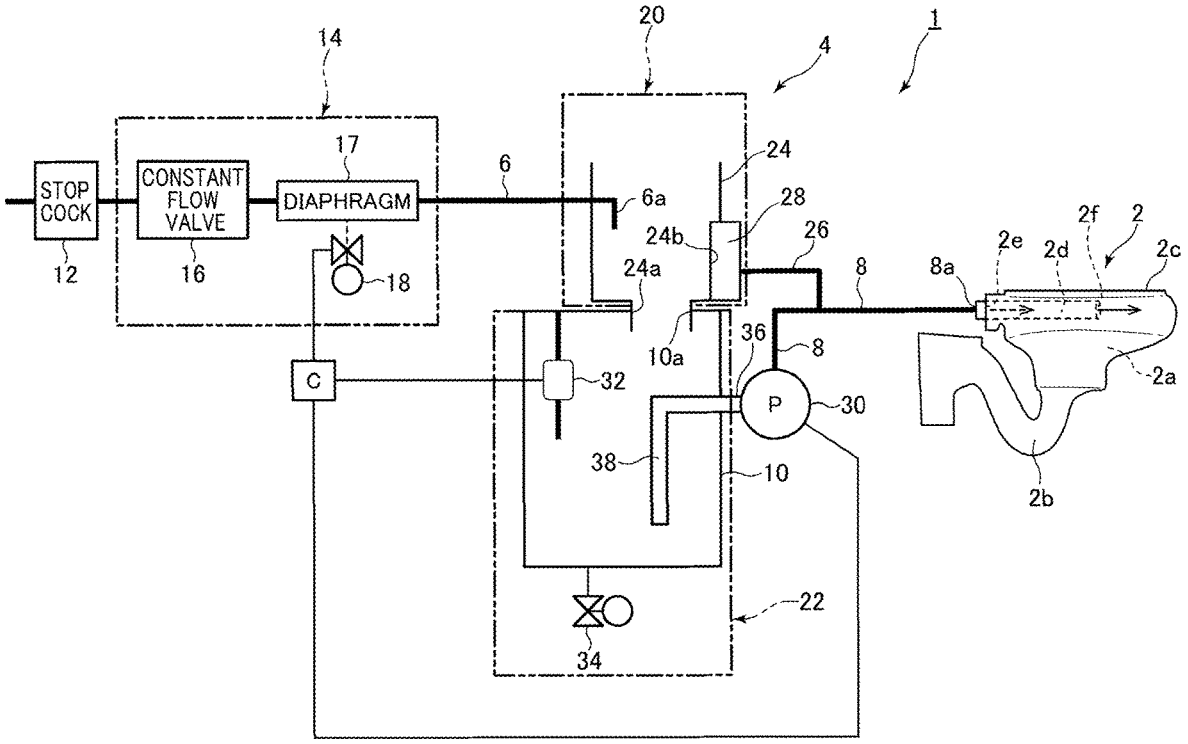
FIG. 2 is an overall configuration diagram of the flush toilet according to the first embodiment of the present invention.

Hereinafter, a flush toilet according to a first embodiment of the present invention will be described with reference to the appended drawings. First, FIG. 1 is a schematic perspective view showing the flush toilet according to the first embodiment of the present invention, where the flush toilet is seen obliquely from behind and above. Furthermore, FIG. 2 is an overall configuration diagram of the flush toilet according to the first embodiment of the present invention. As shown in FIGS. 1 and 2, a flush toilet 1 according to the first embodiment of the present invention includes a toilet main body 2 made of ceramics, and a tank device 4 that is provided behind the toilet main body 2. Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim 2*c* formed at a top edge of the bowl 2*a*.

Next, as shown in FIGS. 1 and 2, the tank device 4 includes a water supply pipe 6 and a water discharge pipe 8 that are connected, respectively, on an upstream side and a downstream side of the tank device 4. An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10. Furthermore, a stop cock 12 and a valve unit 14 are provided on the water supply pipe 6, from the upstream side to the downstream side. Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10. At the valve unit 14, a flow rate of flush water in the water supply pipe 6 is adjusted to be constant by the fixed flow valve 16. Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20.

As shown in FIG. 2, the connecting unit 20 includes a water receiving housing 24, an overflow pipe 26, and a check valve 28. Moreover, the water receiving housing 24 is a connection element, a lower opening 24*a* of which is detachably connected to an upper opening (a water passage port 10*a*) of the storage tank 10 of the tank unit 22, the connection element being connected to the storage tank 10 in a watertight manner.

The overflow pipe 26 connects an overflow port 24*b* provided in a part of a side wall of the water receiving housing 24 and the water discharge pipe 8. The water discharge pipe 8 is a connecting pipe, an upstream side of the water discharge pipe 8 is connected downstream of a pump P of the tank device 4, and a downstream side of the water discharge pipe 8 is connected to a rim conduit 2*d* inside the rim 2*c* of the toilet main body 2. Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

Figure 3:
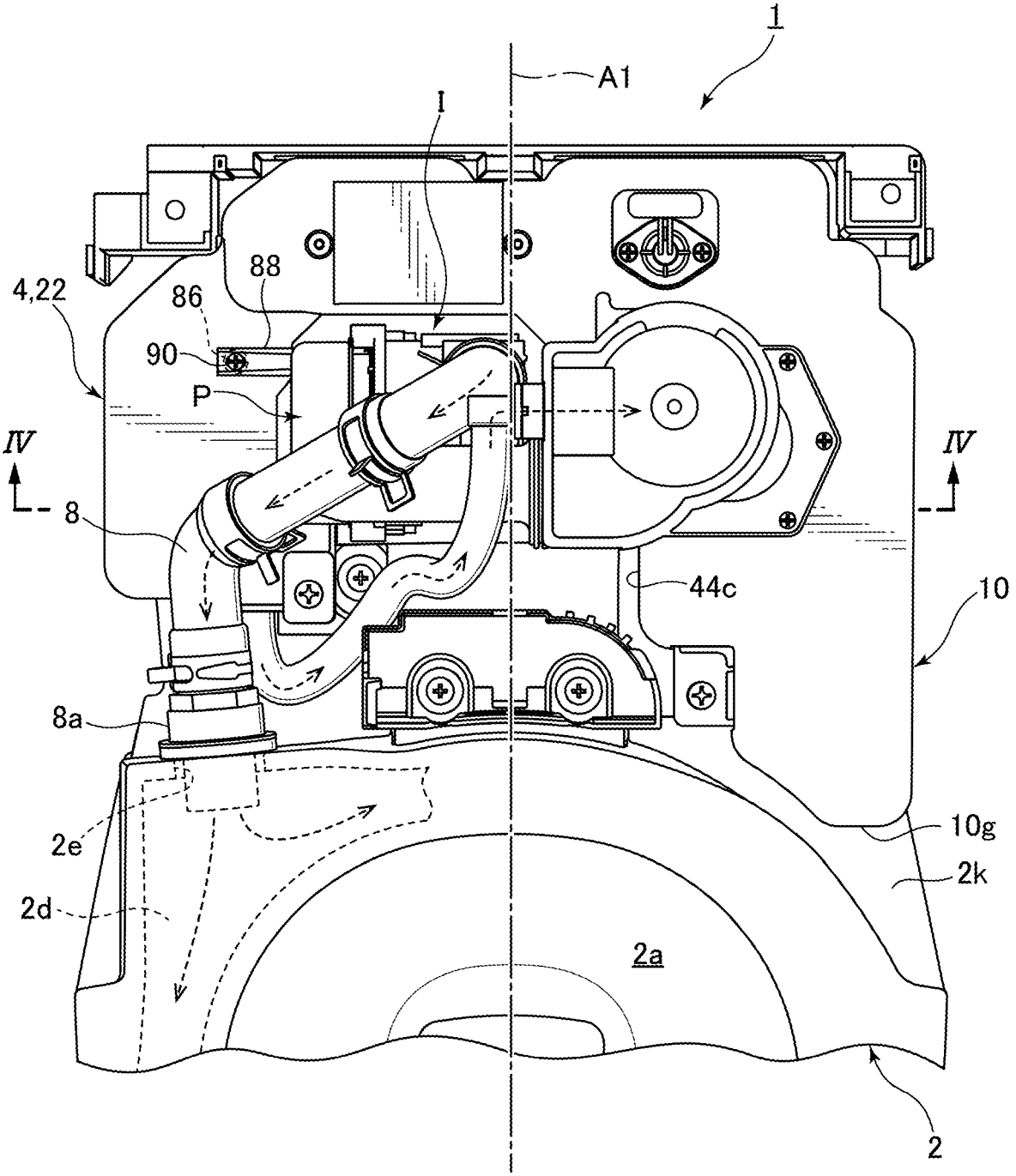
FIG. 3 is an enlarged partial plan view showing a part of the flush toilet according to the first embodiment of the present invention in an enlarged manner, the part corresponding to a tank unit.
Figure 4:
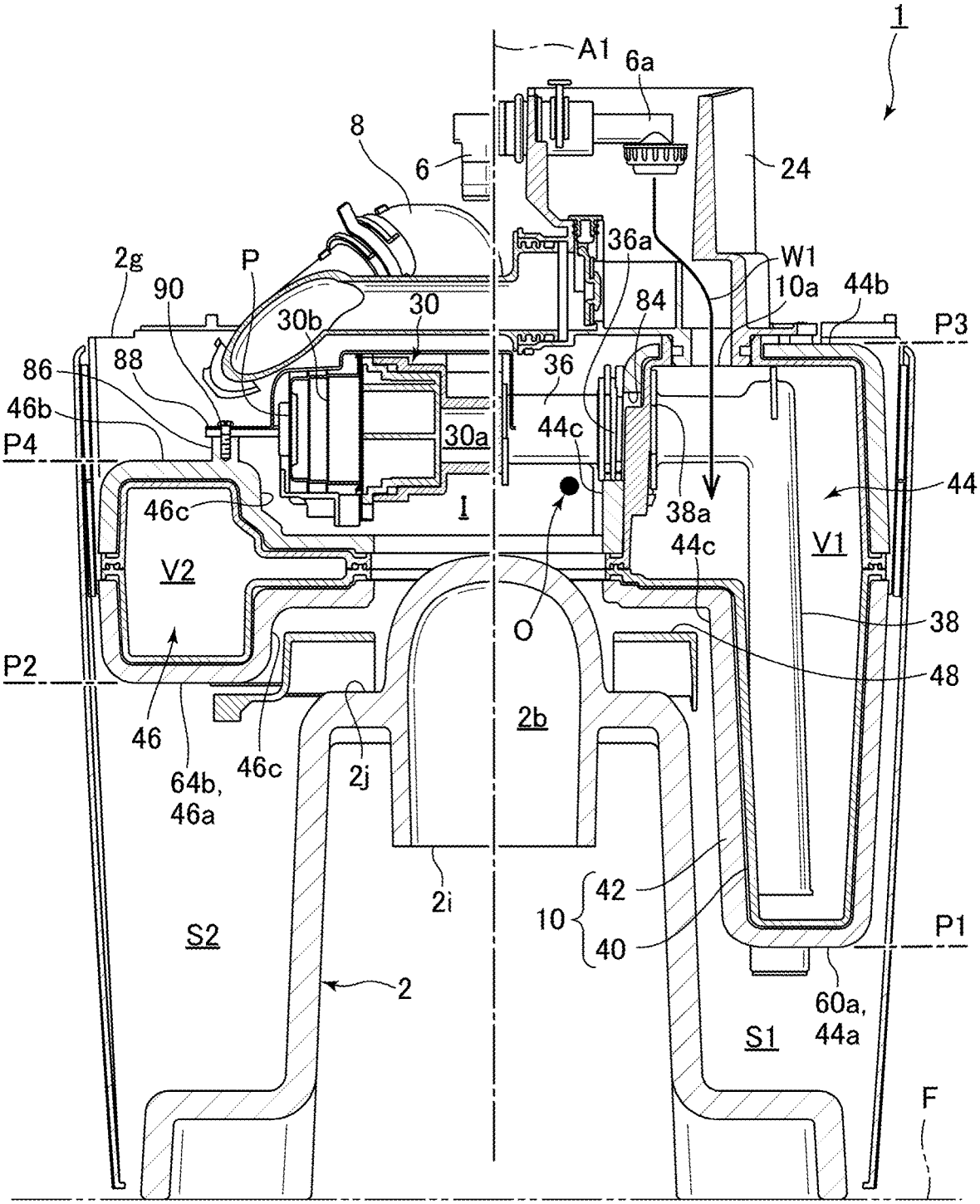
FIG. 4 is a cross-sectional front view taken along a line IV-IV in FIG. 3.

FIG. 3 is an enlarged partial plan view showing a part of the flush toilet according to the first embodiment of the present invention in an enlarged manner, the part corresponding to the tank unit. FIG. 4 is a cross-sectional front view taken along a line IV-IV in FIG. 3. As shown in FIGS. 2 to 4, the tank unit 22 includes the storage tank 10, a pump P (a pump main body 30, a pump connecting pipe 36), a float switch 32, a drain plug 34, a controller C, and the like. First, the pump P is a so-called centrifugal pump (a volute pump) that rotates a spiral impeller (not shown) at a high speed to deliver water by a centrifugal force. More specifically, as shown in FIG. 4, the pump P includes the pump main body 30 inside which a pump chamber 30*a* is formed, and the pump connecting pipe 36 that is provided upstream of the pump main body 30 and that is connected to the storage tank 10. Furthermore, as shown in FIG. 4, a drive unit 30*b*, such as a motor, for rotating the impeller (not shown) that is rotatably provided in the pump chamber 30*a*, and the like are built inside the pump main body 30. Moreover, the pump connecting pipe 36 extends in a left-right direction of the storage tank 10 from the pump main body 30 (the pump chamber 30*a*) toward an upstream side (a lateral side), and an upstream end 36*a* of the pump connecting pipe 36 is connected to a downstream end 38*a* of a suction pipe 38 provided in the storage tank 10. For its part, a downstream side of the pump P is connected to the upstream side of the water discharge pipe 8.

Flush water stored in the storage tank 10 is suctioned from the suction pipe 38 into the pump connecting pipe 36 of the pump P by operation of the pump P, and is then fed under pressure to the water discharge pipe 8 via the pump P. All the flush water that is supplied from the storage tank 10 to the water discharge pipe 8 by the pump P is thus supplied into the rim conduit 2*d* from an inlet 2*e* of the rim conduit 2*d*. Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed.

The float switch 32 detects a water level inside the storage tank 10. An opening/closing operation of the electromagnetic valve 18 of the valve unit 14 is controlled by the controller C based on the water level inside the storage tank 10 that is detected by the float switch 32. Furthermore, the operation of the pump P is also controlled by the controller C based on the water level inside the storage tank 10 that is detected by the float switch 32. For example, in the case where the water level inside the storage tank 10 that is detected by the float switch 32 is at or below a predetermined water level, the electromagnetic valve 18 is opened, the water supply pipe 6 is released, and the pump P is caused to operate. Then, when the water level inside the storage tank 10 reaches the predetermined water level, the electromagnetic valve 18 is closed, the water supply pipe 6 is closed, and the pump P is stopped.

The drain plug 34 is provided in a bottom surface of the storage tank 10. In normal use, the drain plug 34 is closed at all times, and the drain plug 34 can be removed as necessary to discharge the flush water in the storage tank 10 to outside.

Figure 5:
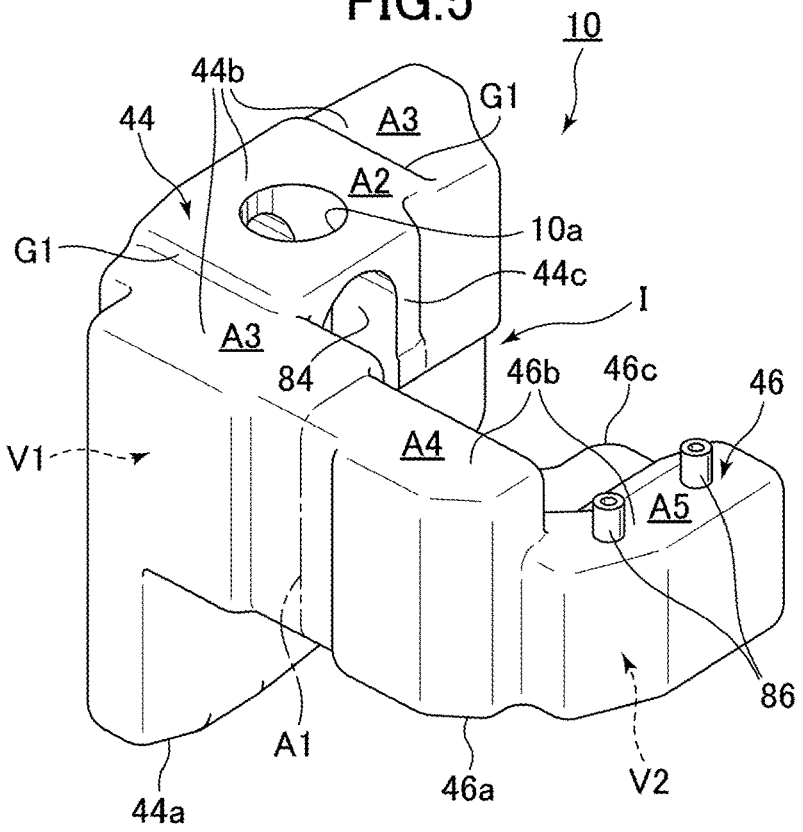
FIG. 5 is a perspective view showing a storage tank of the flush toilet according to the first embodiment of the present invention, where the storage tank is seen obliquely from behind and above.
Figure 6:
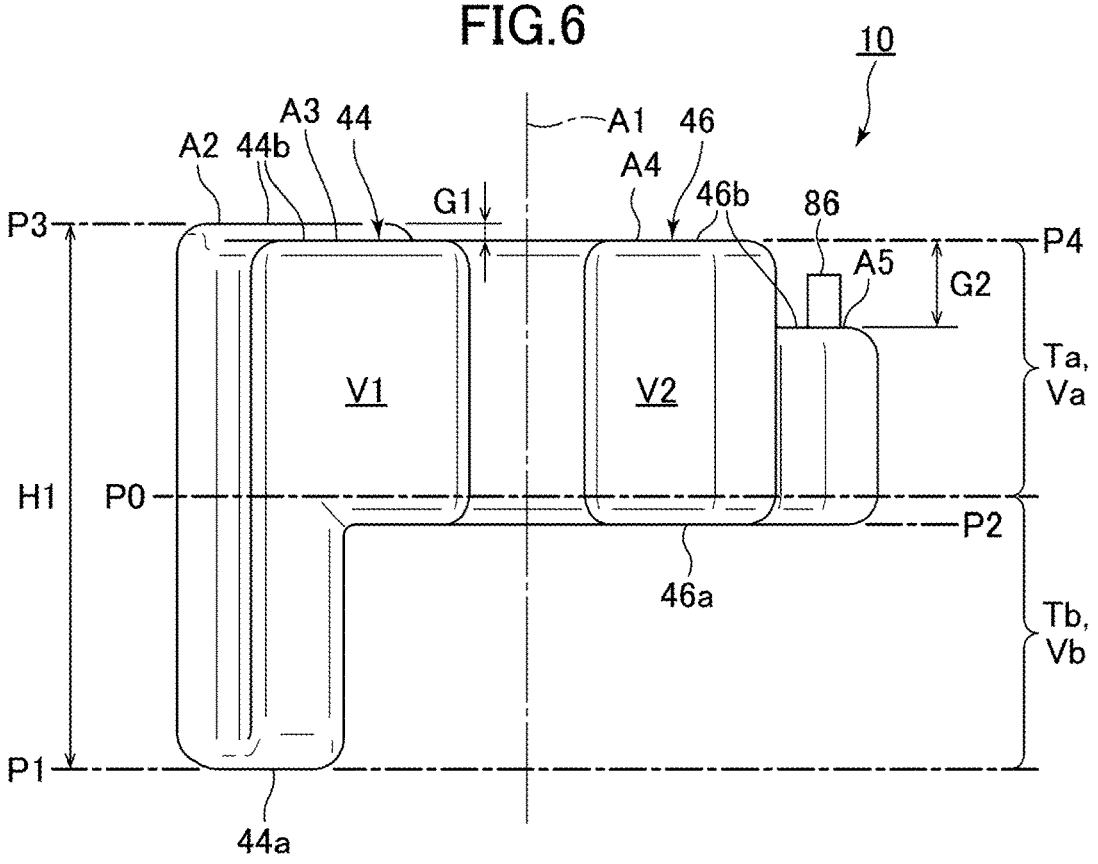
FIG. 6 is a rear view of the storage tank of the flush toilet according to the first embodiment of the present invention.

Next, details of the storage tank 10 of the tank unit 22 will be given with reference to FIGS. 3 to 6. First, as shown in FIGS. 3 and 4, the storage tank 10 of the tank unit 22 includes a single tank main body 40, and an antisweat material 42 covering an outside of the tank main body 40. Next, FIG. 5 is a perspective view showing the storage tank of the flush toilet according to the first embodiment of the present invention, where the storage tank is seen obliquely from behind and above. Furthermore, FIG. 6 is a rear view of the storage tank of the flush toilet according to the first embodiment of the present invention. As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46. That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 are disposed on a right side of the vertical plane A1, and a capacity V1 of the large tank section 44 is set greater than a capacity V2 of the small tank section 46 (V1>V2). Accordingly, because of the large tank section 44 and the small tank section 46, the storage tank 10 has an asymmetrical shape in each of an up-down direction, a front-back direction, and the left-right direction (a deformed shape of an approximately C-shape or U-shape in a plan view). Furthermore, due to such a complex shape of the storage tank 10, a position of a center of gravity O (see FIG. 4) of the storage tank 10 in a full-water state is also shifted to an asymmetrical position in each of the up-down direction, the front-back direction, and the left-right direction of the storage tank 10.

Next, as shown in FIG. 4, the toilet main body 2 includes, in a region behind the bowl 2*a*, a large-tank housing section S1 and a small-tank housing section S1 for housing the large tank section 44 and the small tank section 46, respectively, at a position higher than a floor surface F. That is, in the region behind the bowl 2*a* of the toilet main body 2, the large-tank housing section S1 is formed on one of left and right sides of the vertical plane A1 that divides the region into two in the left-right direction (on the right side of the vertical plane A1 when the toilet main body 2 is seen from front). In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position P1 of a bottom surface 44*a* of the large tank section 44 is located below a lowest position P2 of a bottom surface 46*a* of the small tank section 46. Furthermore, as shown in FIGS. 4 to 6, in the state where the large tank section 44 and the small tank section 46 are disposed in the large-tank housing section S1 and the small-tank housing section S2, respectively, a position P3 (a highest position P3) of an upper surface 44*b* of the large tank section 44 is located above a position P4 of an upper surface 46*b* of the small tank section 46 and lower than an upper surface 2*g* of the rim 2*c* of the toilet main body 2. Additionally, a tank mounting member 48, of which more later, is fixed behind the toilet main body 2, and the storage tank 10 may be attached to the tank mounting member 48 from above. That is, the storage tank 10 is indirectly attached to the toilet main body 2 via the tank mounting member 48. Additionally, the storage tank 10 may alternatively be directly attached to the toilet main body 2, without providing the tank mounting member 48.

Next, as shown in FIG. 6, a capacity Va of an upper part Ta of the storage tank 10 that is located at a position higher than a middle height position (a middle height position P0 in an up-down direction) that equally divides a distance (a vertical-direction distance H1) between the lowest position P1 and the highest position P3 of the large tank section 44 of the storage tank 10 in the up-down direction into two is set greater than a capacity Vb of a lower part Vb of the storage tank 10 that is located at a position lower than the middle height position P0 (Va>Vb). Furthermore, as shown in FIGS. 4 to 6, the upper surface 44*b* of the large tank section 44 of the storage tank 10 and the upper surface 46*b* of the small tank section 46 each include a height difference. Particularly, the water passage port 10*a* is provided in a highest surface A2 of the upper surface 44*b* of the large tank section 44 of the storage tank 10 in a manner penetrating the highest surface A2 in a vertical direction. Thanks to the water passage port 10*a*, flush water W1 supplied to the water receiving housing 24 from a water supply nozzle 6*a* (see FIGS. 2 and 4) that is a water supply device connected to a downstream end of the water supply pipe 6 flows into the storage tank 10 to be stored. Additionally, the present embodiment describes a mode where, in relation to the storage tank 10, the upper surfaces of the large tank section 44 and the small tank section 46 with a height difference to each other are flat surfaces, but such a mode is not restrictive, and a mode is also possible where the highest surface of the storage tank 10 is a flat surface and a height difference is generated by including a surface that slopes downward from the highest surface, for example.

Furthermore, as shown in FIGS. 5 and 6, the upper surface 44*b* of the large tank section 44 of the storage tank 10 is formed such that the upper surface 44*b* becomes lower in a continuous or stepwise manner across a small step G1, from the surface A2 where the water passage port 10*a* is formed toward a surface A3 on an outer periphery of the surface A2. Additionally, the upper surface 44*b* of the large tank section 44 of the storage tank 10 may be formed as a tapered shape, with the upper surface 44*b* sloping downward in a continuous manner from the surface A2 where the water passage port 10*a* is formed toward the surface A3 on the outer periphery of the surface A2, or the upper surface 44*b* may be formed such that the upper surface 44*b* becomes lower in a stepwise manner with a step larger than the small step G1 mentioned above. Moreover, in relation to the upper surface 46*b* of the small tank section 46 of the storage tank 10, a surface A4 extends in a horizontal left-right direction at a same height as the upper surface A3 of the large tank section 44, and a flat surface A5 is formed at a lower position across a step G2.

As shown in FIGS. 2 and 4, the suction pipe 38 is provided inside the large tank section 44 of the tank main body 40, and the upstream end 36*a* of the pump connecting pipe 36 extending on an upstream side (sideways) from the pump main body 30 of the pump P is connected to the downstream end 38*a* of the suction pipe 38, that is a part of the large tank section 44, in a watertight manner. Furthermore, as shown in FIG. 3, an upstream end of the water discharge pipe 8 is connected to a downstream side (upward) from the pump P, and a downstream end (an outlet 8*a*) of the water discharge pipe 8 is connected to the inlet 2*e* of the rim conduit 2*d* on the other one of the left and right sides of the vertical plane A1 of the toilet main body 2 (on the left side of the vertical plane A1 when the toilet main body 2 is seen from the front).

Next, as shown in FIG. 4, an inner side wall surface 44*c* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front). Likewise, an inner side wall surface 46*c* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front). Furthermore, as shown in FIGS. 4 and 5, the discharge trap pipe 2*b* is provided at the center of the toilet main body 2 in the left-right direction, and the upstream end 36*a* of the pump connecting pipe 36 is connected to the inner side wall surface 44*c* that is the side surface, of the large tank section 44, on the discharge trap pipe 2*b* side, of left and right side surfaces of the large tank section 44.

Furthermore, as shown in FIGS. 3 and 4, the pump P is disposed behind the bowl 2*a* of the toilet main body 2, at a position higher than the discharge trap pipe 2*b*. Furthermore, as shown in FIGS. 3, 4 and 6, the storage tank 10 includes a concave region I that is formed into a concave shape by being surrounded by the inner side wall surfaces 44*c*, 46*c* of the large tank section 44 and the small tank section 46, respectively. Moreover, as shown in FIGS. 3, 4 and 6, the pump P is disposed in a middle space (the concave region I) between the large tank section 44 and the small tank section 46 in the left-right direction, and is provided more to the center of the toilet main body 2 in the left-right direction than the upstream end 36*a* of the pump connecting pipe 36 and the downstream end (the outlet 8*a*) of the water discharge pipe 8. The pump P may thus support between the large tank section 44 and the small tank section 46 of the storage tank 10 that is installed on the toilet main body 2, and may function as a deformation-preventing supporting member for preventing deformation of the storage tank 10 (especially deformation of the concave region I). In the present specification, "deformation of storage tank" refers to elastic deformation or plastic deformation of the storage tank 10 itself caused by occurrence of an internal force (or a bending stress, a shearing stress or the like) at the storage tank 10 that is installed on the toilet main body 2, for example. More specifically, such deformation includes bending deformation, shear deformation and the like, and may further include creep deformation (deformation according to which an amount of displacement is increased with passing of time and a creep speed is increased as a temperature of a material is increased), for example.

Figure 7:
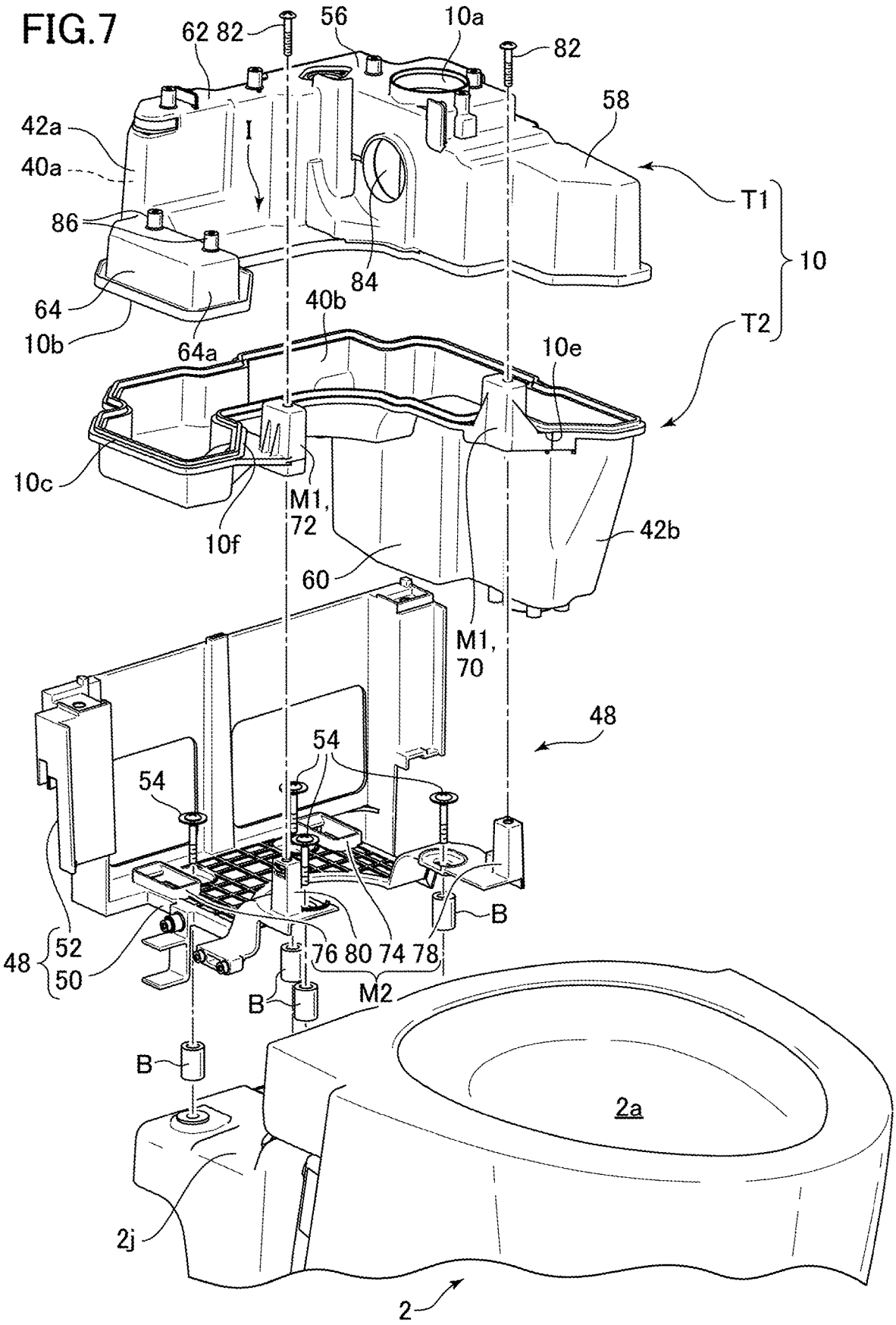
FIG. 7 is an exploded perspective view showing a toilet main body, a tank mounting member, and the storage tank of the flush toilet according to the first embodiment of the present invention.
Figure 8:
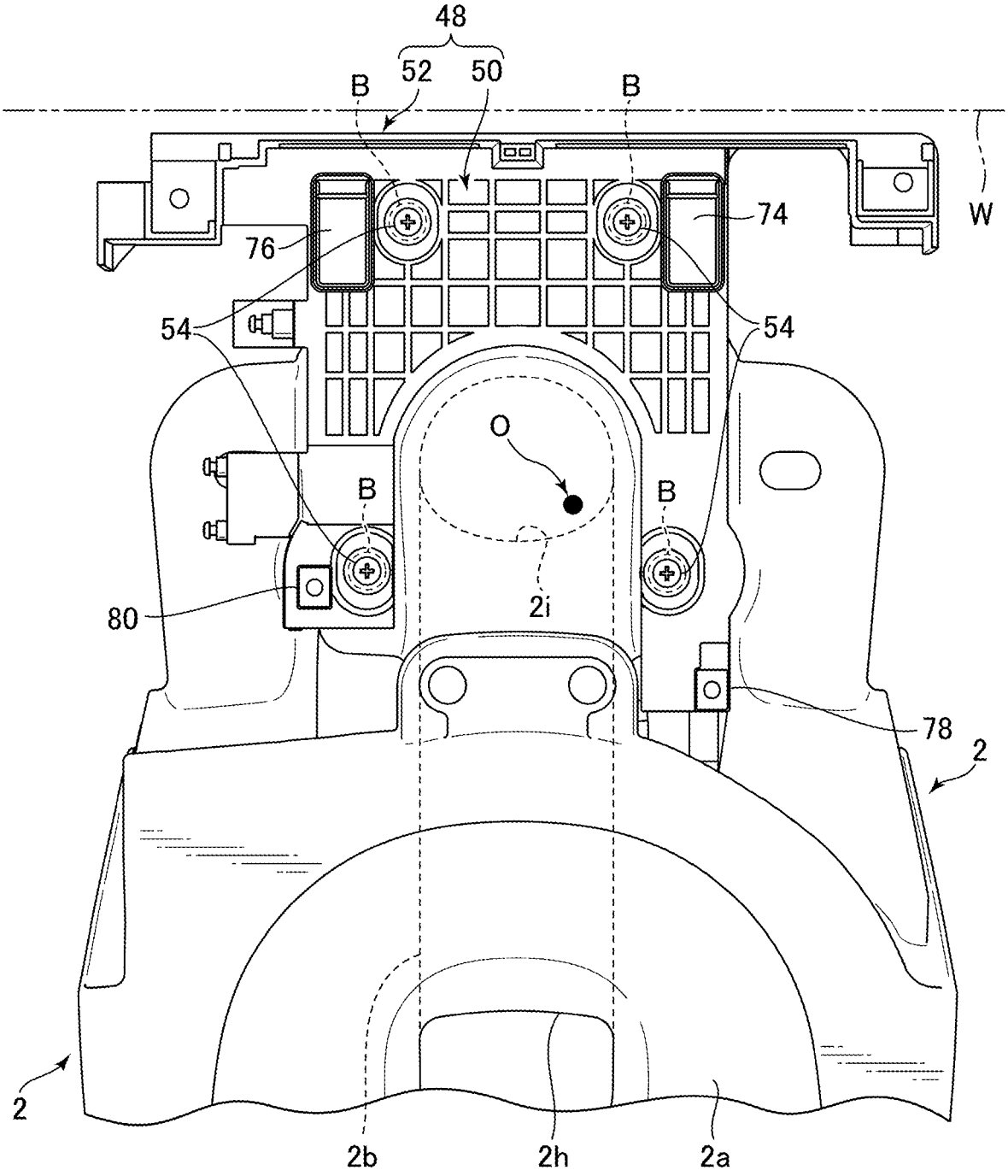
FIG. 8 is a plan view showing a state where the tank mounting member is attached to the toilet main body of the flush toilet according to the first embodiment of the present invention.

Next, a specific description will be given with reference to FIG. 4 and FIGS. 7 to 14, of the tank mounting member 48, mentioned above, that is fixed to the toilet main body 2, and of an attachment structure between a fixing portion (an attaching portion M1) of the storage tank 10 and an attachment-receiving portion M2 of the tank mounting member 48. First, FIG. 7 is an exploded perspective view showing the toilet main body, the tank mounting member, and the storage tank of the flush toilet according to the first embodiment of the present invention. Next, FIG. 8 is a plan view showing a state where the tank mounting member is attached to the toilet main body of the flush toilet according to the first embodiment of the present invention. Furthermore, FIG. 9 is a plan view showing a state where the storage tank is attached, via the tank mounting member, to the toilet main body of the flush toilet according to the first embodiment of the present invention.

Figure 9:
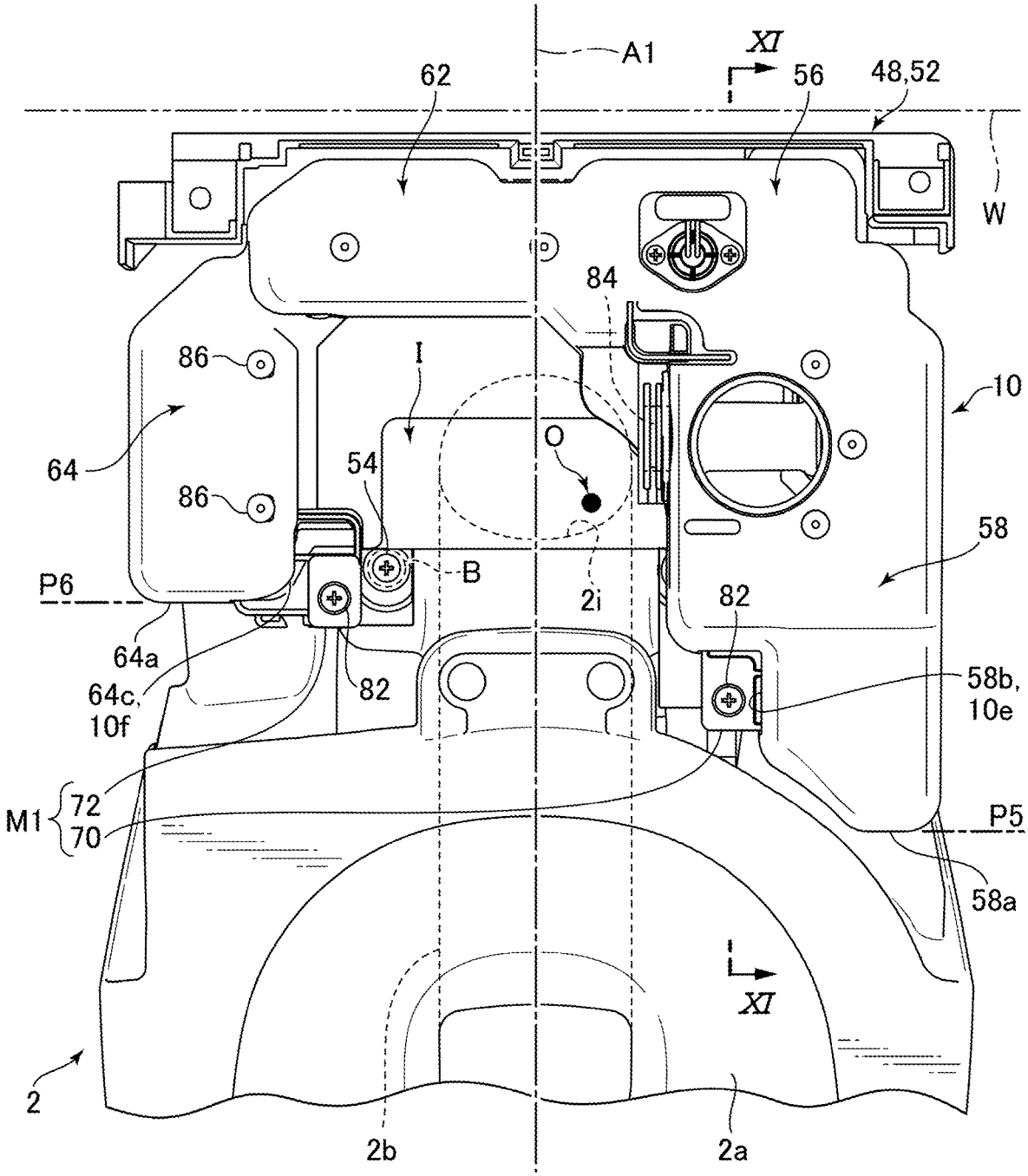
FIG. 9 is a plan view showing a state where the storage tank is attached, via the tank mounting member, to the toilet main body of the flush toilet according to the first embodiment of the present invention.

First, as shown in FIG. 4 and FIGS. 7 to 9, the tank mounting member 48 includes a base (a base plate 50) that is to be fixed behind the bowl 2*a* of the toilet main body 2, and a rear surface-side supporting plate 52 extending upward from a rear end of the base plate 50. Furthermore, in plan views in FIGS. 8 and 9, the discharge trap pipe 2*b* of the toilet main body 2 extends in a front-back direction from an inlet 2*h* of the discharge trap pipe 2*b* connected to a lower part of the bowl 2*a* of the toilet main body 2 to an outlet 2*i* behind the bowl 2*a*. The storage tank 10 is thus disposed in a manner surrounding an upper part of the discharge trap pipe 2*b* from both left and right sides and from a rear side (see FIGS. 4 and 9). Then, as shown in FIGS. 4, 7 and 8, a supporting surface 2*j* that is made of ceramics and to which the base plate 50 is to be fixed is formed at an upper part and on lateral sides of the discharge trap pipe 2*b* of the toilet main body 2, above the outlet 2*i* of the discharge trap pipe 2*b*. Accordingly, the base plate 50 is fixed from above with a plurality (four) of screws 54 while being supported by the supporting surface 2*j* behind the toilet main body 2 from below. Furthermore, as shown in FIGS. 8 and 9, in a state where the tank mounting member 48 is fixed to the toilet main body 2, the rear surface-side supporting plate 52 is disposed adjacent to an external wall surface W on a rear side.

Figure 10:
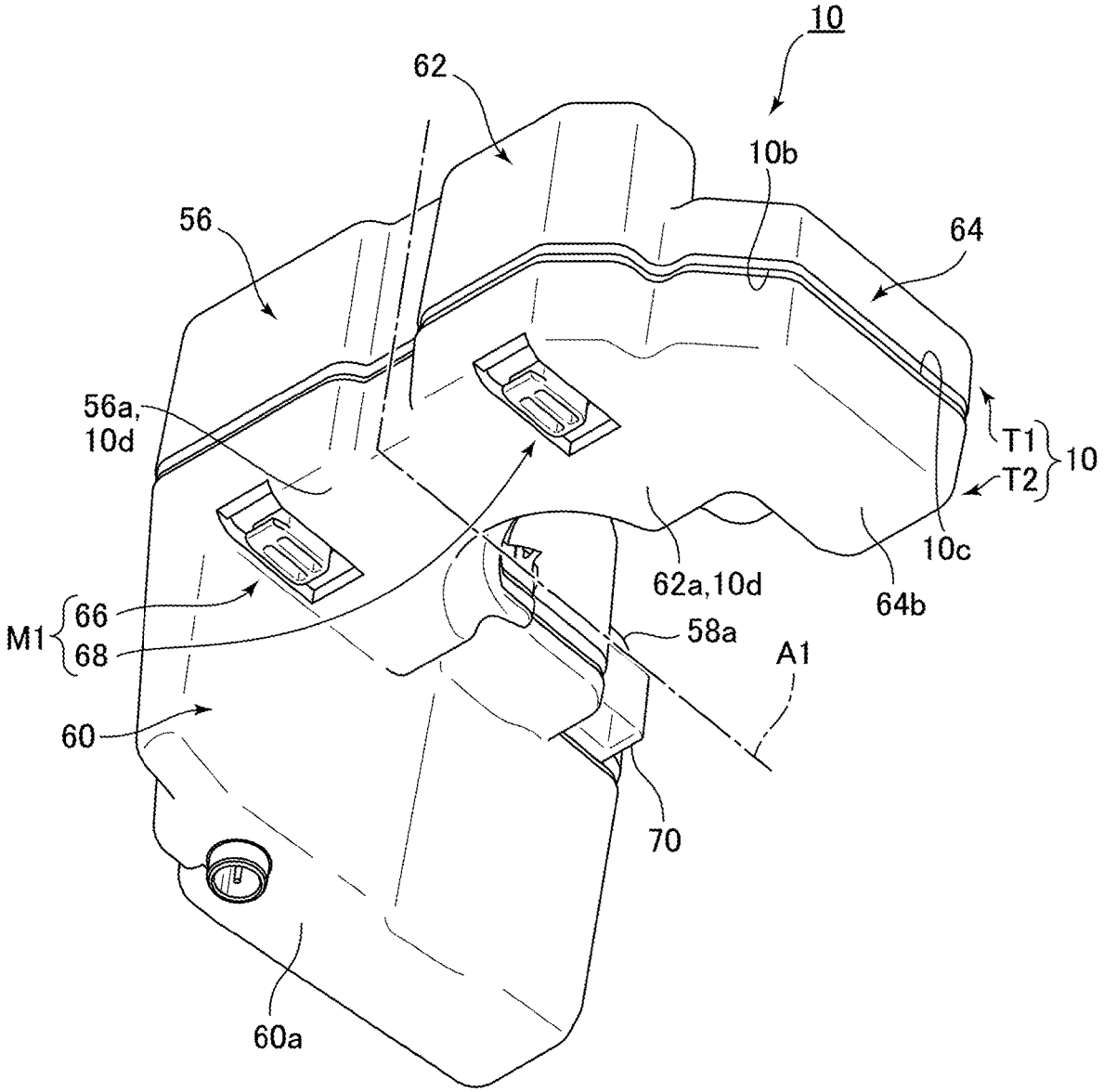
FIG. 10 is a perspective view of the storage tank of the flush toilet according to the first embodiment of the present invention, where the storage tank is seen obliquely from behind and below.
Figure 11:
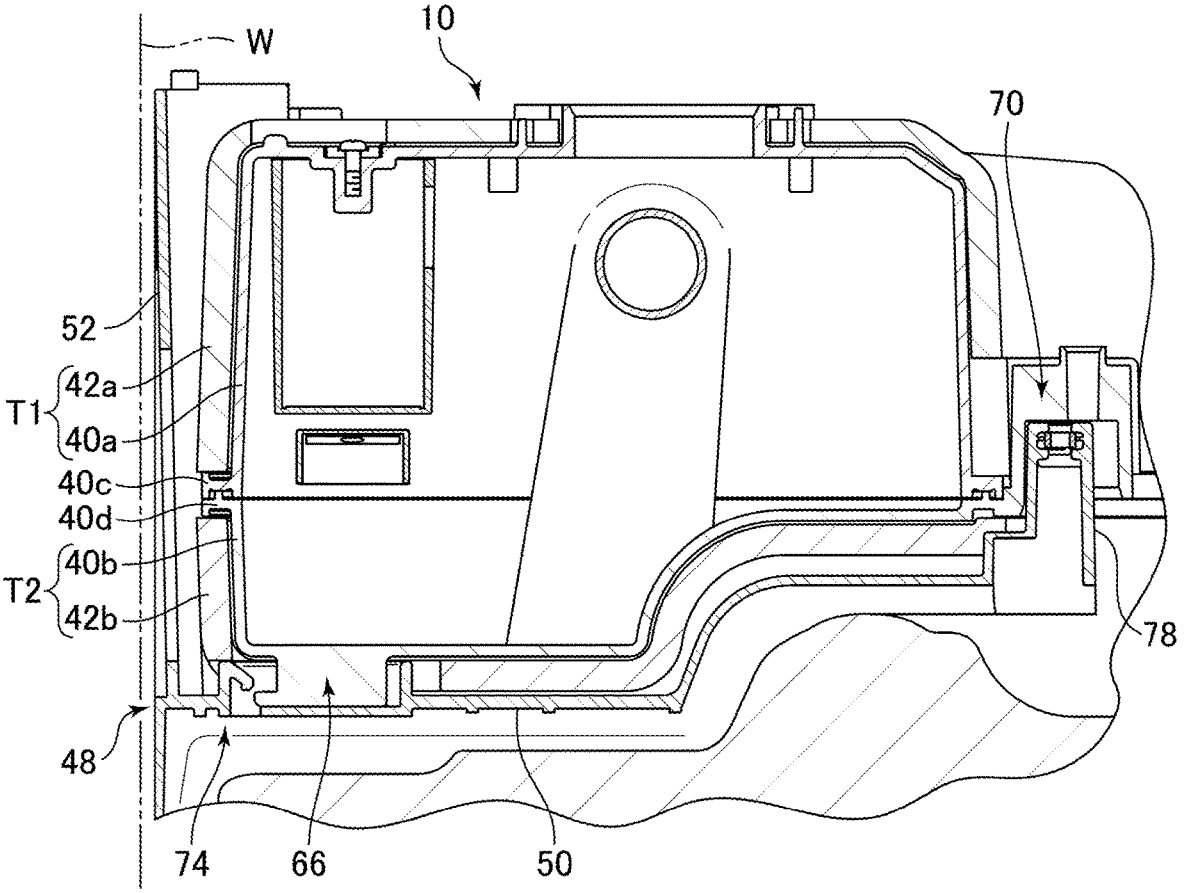
FIG. 11 is a cross-sectional view taken along a line XI-XI in FIG. 9, and is an enlarged partial cross-sectional view showing parts corresponding to the storage tank and the tank mounting member behind the toilet main body in an enlarged manner.

Next, FIG. 10 is a perspective view of the storage tank of the flush toilet according to the first embodiment of the present invention, where the storage tank is seen obliquely from behind and below. Furthermore, FIG. 11 is a cross-sectional view taken along a line XI-XI in FIG. 9, and is an enlarged partial cross-sectional view showing parts corresponding to the storage tank and the tank mounting member behind the toilet main body in an enlarged manner. First, as shown in FIGS. 7, 10 and 11, the storage tank 10 includes a top tank section (a top tank member T1) and a bottom tank section (a bottom tank member T2) that are joined to each other in the up-down direction. Furthermore, the top tank member T1 includes an upper tank main body 40*a* and an upper antisweat material 42*a* on an outside of the upper tank main body 40*a*, and the bottom tank member T2 includes a lower tank main body 40*b* and a lower antisweat material 42*b* on an outside of the lower tank main body 40*b*. That is, in a state where a lower-edge joining portion 10*b* of the top tank member T1 of the storage tank 10 and an upper-edge joining portion 10*c* of the bottom tank member T2 are joined together, a lower-edge joining portion 40*c* of the upper tank main body 40*a* of the top tank member T1 and an upper-edge joining portion 40*d* of the lower tank main body 40*b* of the bottom tank member T2 are joined together in a watertight manner to form a single tank main body 40. Moreover, the tank main body 40 is covered on the outside with the upper antisweat material 42*a* and the lower antisweat material 42*b* from above and below.

Next, as shown in FIGS. 9 and 10, the large tank section 44 of the storage tank 10 includes a rear large tank section 56 disposed behind the discharge trap pipe 2*b*, a front large tank section 58 extending forward from the rear large tank section 56 while being disposed on the one of the left and right sides of the discharge trap pipe 2*b* (the right side when the toilet main body 2 is seen from the front), and a lower large tank section 60 extending downward from the rear large tank section 56. Next, as shown in FIGS. 9 and 10, the small tank section 46 of the storage tank 10 includes a rear small tank section 62 disposed behind the discharge trap pipe 2*b*, and a front small tank section 64 extending forward from the rear small tank section 62 while being disposed on the other one of the left and right sides of the discharge trap pipe 2*b* (the left side when the toilet main body 2 is seen from the front). Furthermore, as shown in FIGS. 9 and 10, a position P5 of a front end 58*a* of the front large tank section 58 is positioned more forward than a position P6 of a front end 64*a* of the front small tank section 64. Moreover, as shown in FIGS. 4 and 10, a bottom surface 60*a* of the lower large tank section 60 is located below a bottom surface 62*a* of the rear small tank section 62 and a bottom surface 64*b* of the front small tank section 64.

Figure 12:
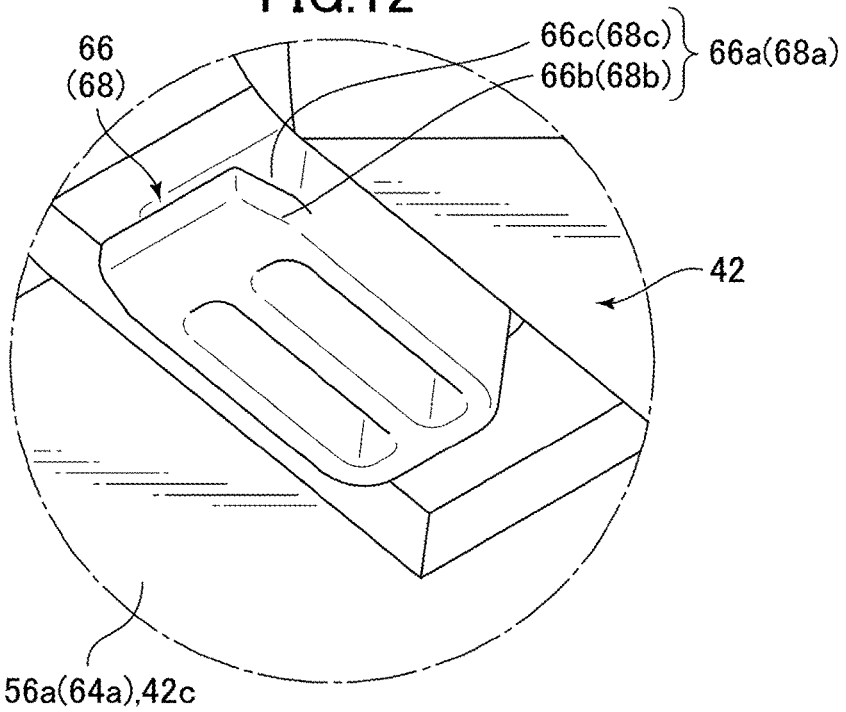
FIG. 12 is an enlarged partial view showing a part of the flush toilet according to the first embodiment of the present invention in an enlarged manner, the part corresponding to an attaching portion of the storage tank shown in FIG. 10.

Next, FIG. 12 is an enlarged partial view showing a part of the flush toilet according to the first embodiment of the present invention in an enlarged manner, the part corresponding to the attaching portion of the storage tank shown in FIG. 10. First, as shown in FIG. 7 and FIGS. 9 to 11, the fixing portions (the attaching portions M1) of the storage tank 10 include, on a bottom surface 56*a* of the rear large tank section 56 of the storage tank 10 and a bottom surface 62*a* of the rear small tank section 62 (that is, a bottom surface 10*d* on a rearward side of the bottom tank member T2 of the storage tank 10 shown in FIG. 10), a pair of left and right large tank-side attaching portion (a rear attaching portion 66) and small tank-side attaching portion (a rear attaching portion 68). Furthermore, as shown in FIG. 7 and FIGS. 9 to 11, the fixing portions (the attaching portions M1) of the storage tank 10 further include, on a part of an inner side surface 58*b* of the front large tank section 58 of the storage tank 10 and a part of an inner side surface 64*c* of the front small tank section 64 (that is, on inner side surfaces 10*e*, 10*f* of the bottom tank member T2 of the storage tank 10 shown in FIGS. 7 and 9), a left and right pair of large tank-side attaching portion (a front attaching portion 70) and small tank-side attaching portion (a front attaching portion 72). That is, as the fixing portion of the storage tank 10 for fixing the storage tank 10 to the toilet main body 2 and the tank mounting member 48, a plurality of (four) attaching portions M1 (66, 68, 70, 72) are provided only on the bottom tank member T2 side, and no fixing portion is provided on the top tank member T1 side. Additionally, the present embodiment describes a mode where a plurality of (four) fixing portions of the storage tank 10 are provided only on the bottom tank member T2, but the plurality of fixing portions are not limited to four. Alternatively, the fixing portion of the storage tank 10 may be provided on each of the top tank member T1 and the bottom tank member T2. In this case, the number of fixing portions of the storage tank 10 is desirably greater for the bottom tank member T2 than for the top tank member T1.

As shown in FIGS. 7, 8 and 11, the attachment-receiving portion M2 of the tank mounting member 48 includes a pair of left and right rear attachment-receiving portions 74, 76 that are provided on a rear side on the base plate 50 of the tank mounting member 48. The rear attaching portions 66, 68 of the storage tank 10 can be attached to the corresponding attachment-receiving portions 74, 76 from above. Furthermore, as shown in FIGS. 7, 8 and 11, the attachment-receiving portion M2 of the tank mounting member 48 further includes a pair of left and right front attachment-receiving portions 78, 80 that are provided on a front side of the base plate 50 of the tank mounting member 48. The front attaching portions 70, 72 of the storage tank 10 can be attached to the corresponding attachment-receiving portions 78, 80 from above. Additionally, the attaching portions 66, 70 of the storage tank 10 and the attachment-receiving portions 74, 78 of the tank mounting member 48 shown in FIG. 11 are in a state where the attaching portions 66, 70 of the storage tank are attached and engaged with the corresponding attachment-receiving portions 74, 78 of the tank mounting member 48 from above but are not yet fixed to each other.

Figure 13A:
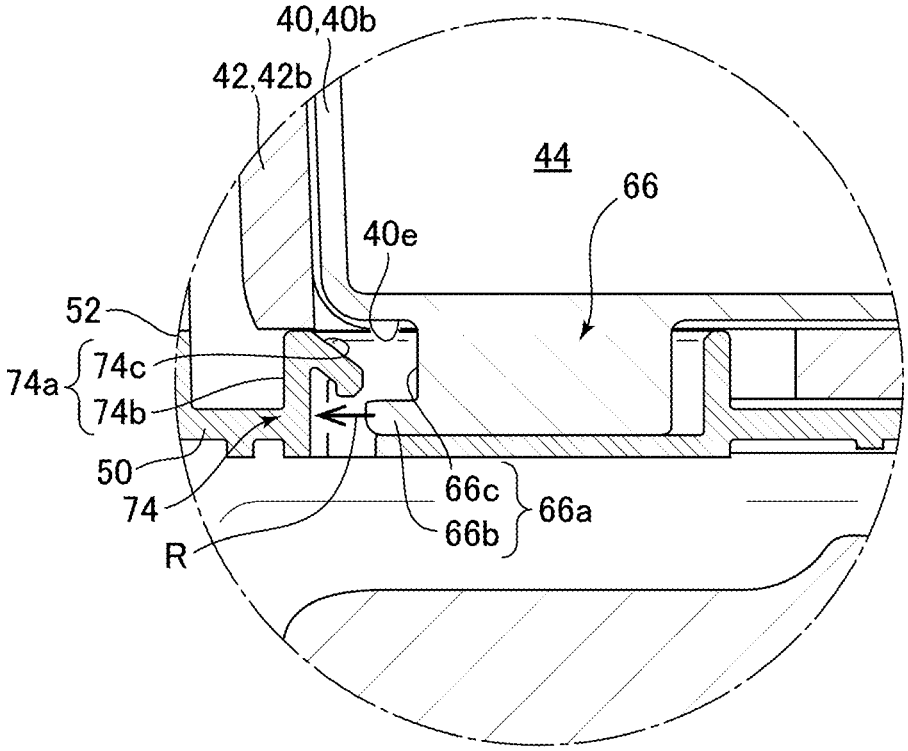
FIG. 13A is an enlarged partial cross-sectional view showing a part of the flush toilet according to the first embodiment of the present invention shown in FIG. 11 in an enlarged manner, the part corresponding to a large-tank rear attaching portion of the storage tank and a rear attachment-receiving portion of the tank mounting member, FIG. 13A showing a state before the large-tank rear attaching portion of the storage tank is moved rearward after being engaged with the rear attachment-receiving portion of the tank mounting member from above (a pre-positioning state)
Figure 13B:
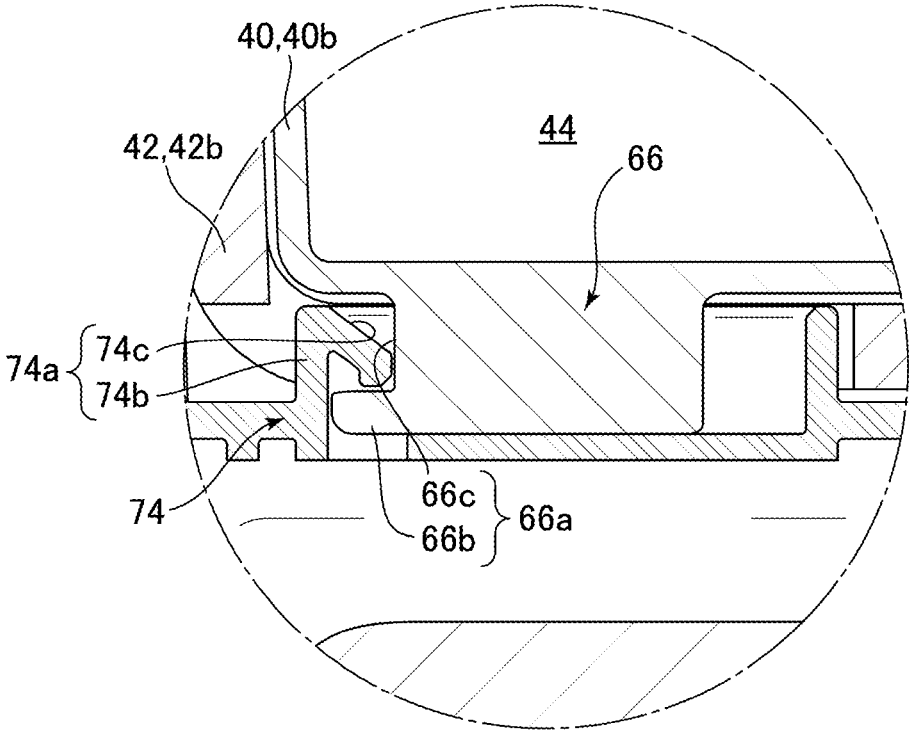
FIG. 13B is, like FIG. 13A, an enlarged partial cross-sectional view showing a part of the flush toilet according to the first embodiment of the present invention in an enlarged manner, the part corresponding to the large-tank rear attaching portion of the storage tank and the rear attachment-receiving portion of the tank mounting member, FIG. 13B showing a state where the large-tank rear attaching portion of the storage tank is moved rearward after being engaged with the rear attachment-receiving portion of the tank mounting member from above and positioning is completed (a positioning completion state)
Figure 13C:
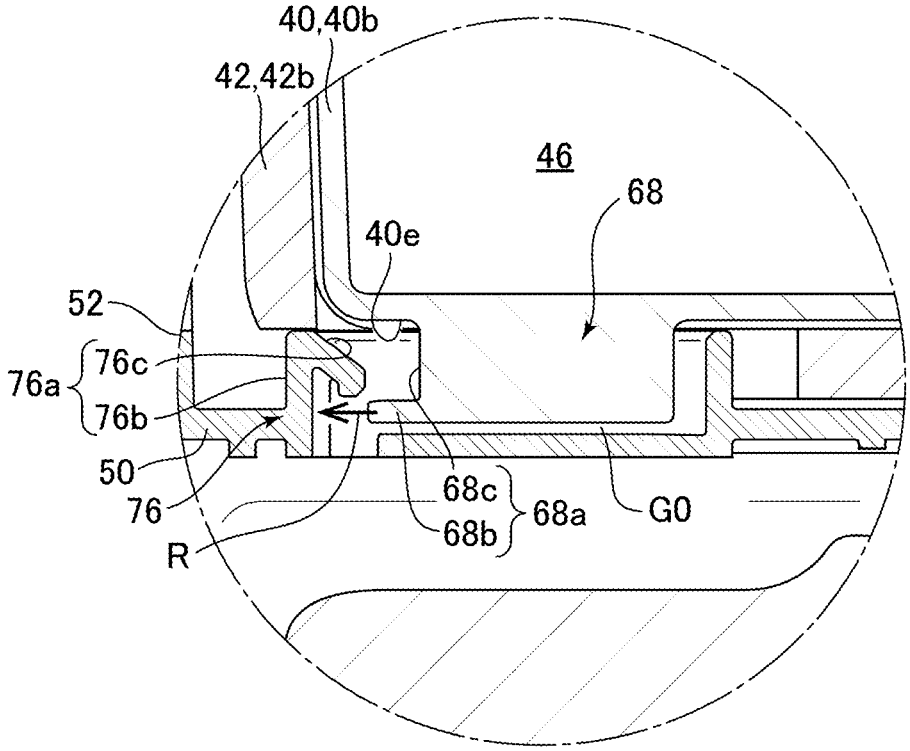
FIG. 13C is, like FIG. 13A, an enlarged partial cross-sectional view showing a part of the flush toilet according to the first embodiment of the present invention in an enlarged manner, the part corresponding to a small-tank rear attaching portion of the storage tank and a rear attachment-receiving portion of the tank mounting member, FIG. 13C showing a state before the small-tank rear attaching portion of the storage tank is moved rearward after being engaged with the rear attachment-receiving portion of the tank mounting member from above (a pre-positioning state)
Figure 13D:
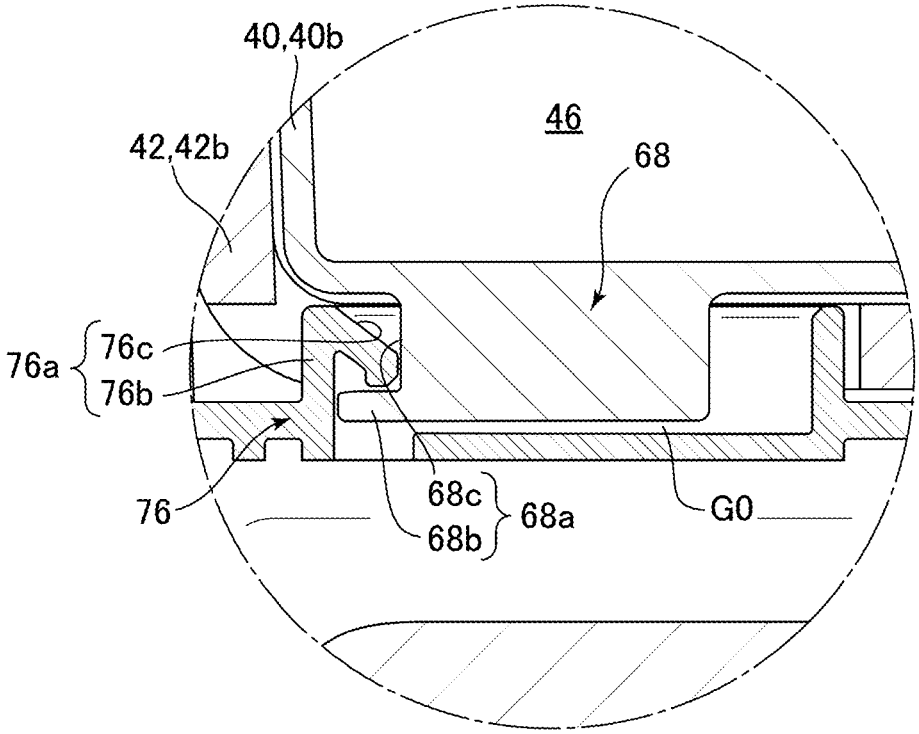
FIG. 13D is, like FIG. 13C, an enlarged partial cross-sectional view showing a part of the flush toilet according to the first embodiment of the present invention in an enlarged manner, the part corresponding to the small-tank rear attaching portion of the storage tank and the rear attachment-receiving portion of the tank mounting member, FIG. 13D showing a state where the small-tank rear attaching portion of the storage tank is moved rearward after being engaged with the rear attachment-receiving portion of the tank mounting member from above and positioning is completed (a positioning completion state)

Next, FIG. 12 is an enlarged partial view showing a part of the flush toilet according to the first embodiment of the present invention in an enlarged manner, the part corresponding to the attaching portion of the storage tank shown in FIG. 10. Furthermore, FIG. 13A is an enlarged partial cross-sectional view showing a part of the flush toilet according to the first embodiment of the present invention shown in FIG. 11 in an enlarged manner, the part corresponding to the large-tank rear attaching portion of the storage tank and the rear attachment-receiving portion of the tank mounting member, FIG. 13A showing a state before the large-tank rear attaching portion of the storage tank is moved rearward after being engaged with the rear attachment-receiving portion of the tank mounting member from above (a pre-positioning state). FIG. 13B is, like FIG. 13A, an enlarged partial cross-sectional view, and shows a state where the large-tank rear attaching portion of the storage tank is moved rearward after being engaged with the rear attachment-receiving portion of the tank mounting member from above and positioning is completed (a positioning completion state). Next, FIG. 13C is, like FIG. 13A, an enlarged partial cross-sectional view showing a part of the flush toilet according to the first embodiment of the present invention in an enlarged manner, the part corresponding to the small-tank rear attaching portion of the storage tank and the rear attachment-receiving portion of the tank mounting member, FIG. 13C showing a state before the small-tank rear attaching portion of the storage tank is moved rearward after being engaged with the rear attachment-receiving portion of the tank mounting member from above (a pre-positioning state). FIG. 13D is, like FIG. 13C, an enlarged partial cross-sectional view showing a part of the flush toilet according to the first embodiment of the present invention in an enlarged manner, the part corresponding to the small-tank rear attaching portion of the storage tank and the rear attachment-receiving portion of the tank mounting member, FIG. 13D showing a state where the small-tank rear attaching portion of the storage tank is moved rearward after being engaged with the rear attachment-receiving portion of the tank mounting member from above and positioning is completed (a positioning completion state).

First, as shown in FIGS. 12, 13A, 13C and 14A, each rear attaching portion 66, 68 of the storage tank 10 protrudes downward from the bottom surface of the tank main body 40, and a lower end thereof is a foot portion that can come into contact with a bottom surface inside the corresponding rear attachment-receiving portion 74, 76 of the tank mounting member 48. Furthermore, the antisweat material 42 is cut out around each rear attaching portion 66, 68 of the storage tank 10, and the lower end of each rear attaching portion 66, 68 (a bottom surface of the foot portion) is at a position that is slightly lower than the bottom surface 56*a*, 62*a* of the storage tank 10 (a bottom surface 42*c* of the antisweat material 42). Furthermore, a locking portion (an attaching-side locking portion 66*a*, 68*a*) to be locked with the corresponding rear attachment-receiving portion 74, 76 of the tank mounting member 48 is provided at a lower end portion (the foot portion) of the corresponding rear attaching portion 66, 68. As shown in FIGS. 13A to 13D, each rear attachment-receiving portion 74, 76 of the tank mounting member 48 is formed into a concave shape so as to be able to wholly receive the corresponding rear attaching portion 66, 68 of the storage tank 10 from above, and a locking portion (an attachment receiving-side locking portion 74*a*, 76*a*) that can be locked together with the corresponding attaching-side locking portion 66*a*, 68*a* of the rear attaching portion 66, 68 of the storage tank 10 is provided on a rear side of the rear attachment-receiving portion 74, 76. Next, as shown in FIGS. 12, and 13A to 13D, each locking portion 66*a*, 68*a* of the storage tank 10 includes a locking projection 66*b*, 68*b* protruding rearward from a rear end of a bottom portion of the corresponding attaching portion 66, 68, and a locking concave portion 66*c*, 68*c* that is formed between the locking projection 66*b*, 68*b* and the bottom surface 40*e* of the tank main body 40 above. Furthermore, as shown in FIGS. 13A to 13D, each locking portion 74*a*, 76*a* of the tank mounting member 48 includes a locking projection 74*b*, 76*b* that protrudes upward from near a rear end of the base plate 50.

As shown in FIG. 13A, when the storage tank 10 is attached from above to the tank mounting member 48 fixed behind the toilet main body 2, a bottom surface of the large-tank rear attaching portion 66 of the storage tank 10 is placed in a state where the bottom surface is in contact and engaged with the bottom surface of the rear attachment-receiving portion 74 of the tank mounting member 48 from above. However, as shown in FIG. 13A, because the attaching-side locking portion 66*a* of the large-tank rear attaching portion 66 of the storage tank 10 and the corresponding attachment receiving-side locking portion 74*a* of the rear attachment-receiving portion 74 of the tank mounting member 48 are not locked with each other, the attaching-side locking portion 66*a* of the large-tank rear attaching portion 66 of the storage tank 10 is in a state where the attaching-side locking portion 66*a* is not positioned relative to the corresponding attachment receiving-side locking portion 74*a* of the rear attachment-receiving portion 74 of the tank mounting member 48 (a pre-positioning state). Then, when the storage tank 10 is moved rearward relative to the tank mounting member 48, the large-tank rear attaching portion 66 of the storage tank 10 in the state shown in FIG. 13A is moved rearward (in an arrow R direction in FIG. 13A) relative to the rear attachment-receiving portion 74 of the tank mounting member 48. Then, as shown in FIG. 13B, the attaching-side locking portion 66*a* of the large-tank rear attaching portion 66 of the storage tank 10 and the corresponding attachment receiving-side locking portion 74*a* of the rear attachment-receiving portion 74 of the tank mounting member 48 are locked with each other. That is, as shown in FIG. 13B, a rear end portion of the locking projection 66*b* of the attaching-side locking portion 66*a* of the large-tank rear attaching portion 66 of the storage tank 10 abuts against a front surface of the locking projection 74*b* of the attachment receiving-side locking portion 74*a* of the rear attachment-receiving portion 74 of the tank mounting member 48. At this time, the front end portion of the attachment receiving-side locking portion 74*a* of the rear attachment-receiving portion 74 of the tank mounting member 48 is fitted inside the locking concave portion 66*c* of the attaching-side locking portion 66*a* of the large-tank rear attaching portion 66 of the storage tank 10. As a result, as shown in FIG. 13B, a state is reached where each attaching-side locking portion 66*a* of the large-tank rear attaching portion 66 of the storage tank 10 is positioned relative to the respective attachment receiving-side locking portion 74*a* of the rear attachment-receiving portion 74 of the tank mounting member 48 (a positioning completion state).

Next, as shown in FIG. 13C, when the storage tank 10 is attached from above to the tank mounting member 48 fixed behind the toilet main body 2, a bottom surface of the small-tank rear attaching portion 68 of the storage tank 10 is placed in a state where the bottom surface is not in contact with the bottom surface of rear attachment-receiving portion 76 of the tank mounting member 48 positioned below the aforementioned bottom surface and a gap G0 is formed. However, as shown in FIG. 13C, because the attaching-side locking portion 68*a* of the small-tank rear attaching portion 68 of the storage tank 10 and the corresponding attachment receiving-side locking portion 76*a* of the rear attachment-receiving portion 76 of the tank mounting member 48 are not locked with each other, the attaching-side locking portion 68*a* of the small-tank rear attaching portion 68 of the storage tank 10 is in a state where the attaching-side locking portion 68*a* is not positioned relative to the corresponding attachment receiving-side locking portion 76*a* of the rear attachment-receiving portion 76 of the tank mounting member 48 (a pre-positioning state). Then, when the storage tank 10 is moved rearward relative to the tank mounting member 48, the small-tank rear attaching portion 68 of the storage tank 10 in the state shown in FIG. 13C is moved rearward (in an arrow R direction in FIG. 13C) relative to the rear attachment-receiving portion 76 of the tank mounting member 48. Then, as shown in FIG. 13D, the attaching-side locking portion 68*a* of the small-tank rear attaching portion 68 of the storage tank 10 and the corresponding attachment receiving-side locking portion 76*a* of the rear attachment-receiving portion 76 of the tank mounting member 48 are locked with each other. That is, as shown in FIG. 13D, a rear end portion of the locking projection 68*b* of the attaching-side locking portion 68*a* of the small-tank rear attaching portion 68 of the storage tank 10 abuts against a front surface of the locking projection 76*b* of the attachment receiving-side locking portion 76*a* of the rear attachment-receiving portion 76 of the tank mounting member 48. At this time, the front end portion of the attachment receiving-side locking portion 76*a* of the rear attachment-receiving portion 76 of the tank mounting member 48 is fitted inside the locking concave portion 68*c* of the attaching-side locking portion 68*a* of the small-tank rear attaching portion 68 of the storage tank 10. As a result, as shown in FIG. 13D, a state is reached where each attaching-side locking portion 68*a* of the small-tank rear attaching portion 68 of the storage tank 10 is positioned relative to the respective attachment receiving-side locking portion 76*a* of the rear attachment-receiving portion 76 of the tank mounting member 48 (a positioning completion state). At this time, a state is maintained where the bottom surface of the small-tank rear attaching portion 68 of the storage tank 10 is not in contact with the bottom surface of rear attachment-receiving portion 76 of the tank mounting member 48 positioned below the aforementioned bottom surface and the gap G0 is formed.

Furthermore, as shown in FIGS. 13A to 13D, the locking projections 74*b*, 76*b* of the locking portions 74*a*, 76*a* of the rear attachment-receiving portions 74, 76 of the tank mounting member 48 include, respectively, sloping surfaces 74*c*, 76*c* sloping obliquely downward to the front from upper ends of the locking projections 74*b*, 76*b*. Accordingly, even if, at the time of attachment of the rear attaching portions 66, 68 of the storage tank 10 to the corresponding rear attachment-receiving portions 74, 76 of the tank mounting member 48 from above, the attaching-side locking portions 66*a*, 68*a* of the rear attaching portions 66, 68 of the storage tank 10 are placed on top of the sloping surfaces 74*c*, 76*c* or the upper ends of the locking projections 74*b*, 76*b* of the attachment-receiving portions 74, 76 of the tank mounting member 48 from above, the sloping surfaces 74*c*, 76*c* may function as guiding surfaces for guiding the corresponding locking portions 66*a*, 68*a* of the attaching portions 66, 68 of the storage tank 10 from the back to ranges inside the attachment-receiving portions 74, 76 of the tank mounting member 48 in front.

Figure 14A:
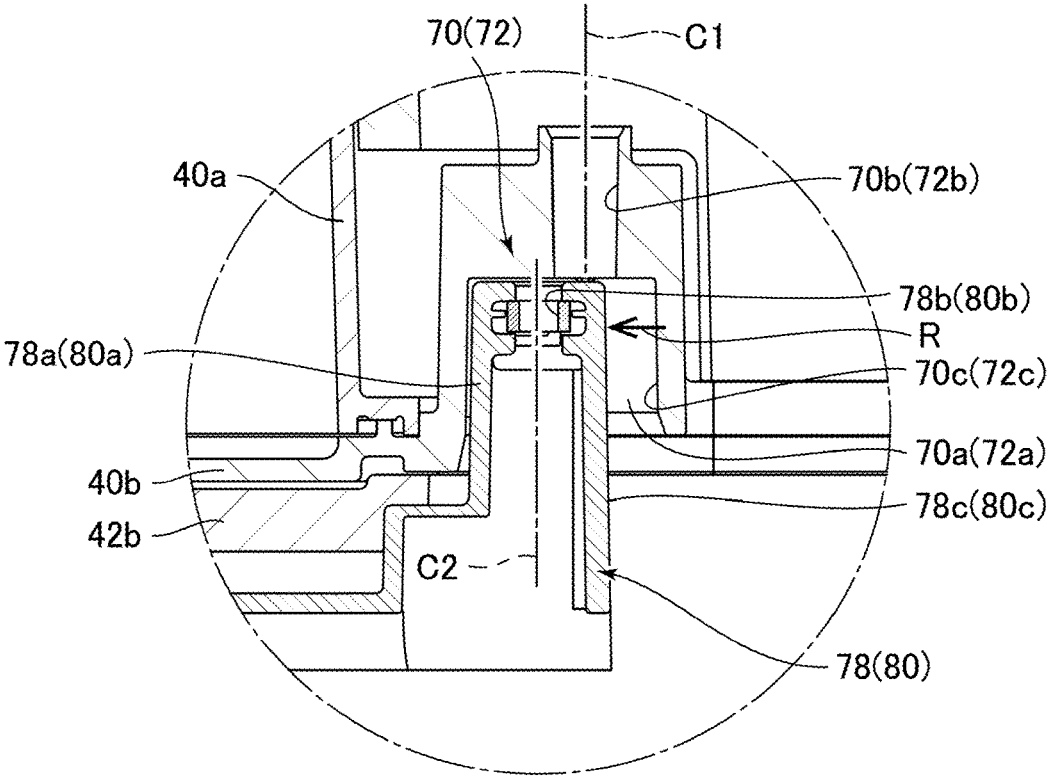
FIG. 14A is an enlarged partial cross-sectional view showing a part of the flush toilet according to the first embodiment of the present invention shown in FIG. 11 in an enlarged manner, the part corresponding to a front attaching portion of the storage tank and a front attachment-receiving portion of the tank mounting member, FIG. 14A showing a state before the front attaching portion of the storage tank is moved rearward after being engaged with the front attachment-receiving portion of the tank mounting member from above (a pre-positioning state)
Figure 14B:
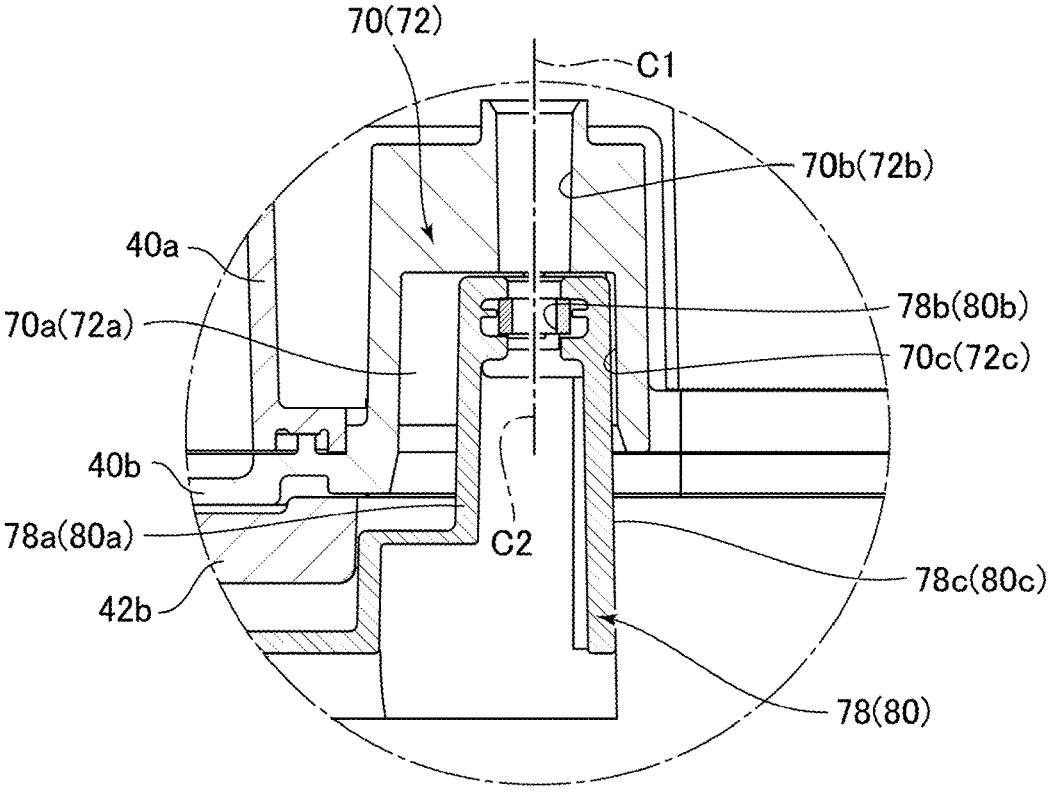
FIG. 14B is, like FIG. 14A, an enlarged partial cross-sectional view showing a part of the flush toilet according to the first embodiment of the present invention in an enlarged manner, the part corresponding to the front attaching portion of the storage tank and the front attachment-receiving portion of the tank mounting member, FIG. 14B showing a state where the front attaching portion of the storage tank is moved rearward after being engaged with the front attachment-receiving portion of the tank mounting member from above and positioning is completed (a positioning completion state)

Next, FIG. 14A is an enlarged partial cross-sectional view showing a part of the flush toilet according to the first embodiment of the present invention shown in FIG. 11 in an enlarged manner, the part corresponding to the front attaching portion of the storage tank and the front attachment-receiving portion of the tank mounting member, FIG. 14A showing a state before the front attaching portion of the storage tank is moved rearward after being engaged with the front attachment-receiving portion of the tank mounting member from above (a pre-positioning state). FIG. 14B is, like FIG. 14A, an enlarged partial cross-sectional view, and shows a state where the front attaching portion of the storage tank is moved rearward after being engaged with the front attachment-receiving portion of the tank mounting member from above and positioning is completed (a positioning completion state). As shown in FIGS. 14A and 14B, each front attaching portion 70, 72 of the storage tank 10 and the corresponding front attachment-receiving portion 78, 80 of the tank mounting member 48 are screw-fixing portions that can be screw-fixed to each other (hereinafter referred to as "the screw-fixing portion(s) 70, 72 of the storage tank 10" and "the screw-fixing portion(s) 78, 80 of the tank mounting member 48"). Specifically, as shown in FIGS. 14A and 14B, the screw-fixing portions 78, 80 of the tank mounting member 48 include protruding portions 78*a*, 80*a* protruding upward from both left and right sides in a front region of the base plate 50, and screw holes (lower screw holes 78*b*, 80*b*) penetrating the protruding portions 78*a*, 80*a* in an up-down direction.

As shown in FIGS. 14A and 14B, fitting concave portions 70*a*, 72*a* where the protruding portions 78*a*, 80*a* of the screw-fixing portions 78, 80 of the tank mounting member 48 can be inserted from below are provided below the screw-fixing portions 70, 72 of the storage tank 10. Furthermore, the fitting concave portions 70*a*, 72*a* of the storage tank 10 are formed larger than a dimension of the protruding portions 78*a*, 80*a* of the screw-fixing portions 78, 80 of the tank mounting member 48 in the front-back direction. Accordingly, in a state where the fitting concave portions 70*a*, 72*a* of the storage tank 10 are fitted (engaged) with the corresponding protruding portions 78*a*, 80*a* of the screw-fixing portions 78, 80 of the tank mounting member 48, the screw-fixing portions 70, 72 of the storage tank 10 are capable of sliding in the front-back direction relative to the corresponding screw-fixing portions 78, 80 of the tank mounting member 48.

Furthermore, screw holes (upper screw holes 70*b*, 72*b*) penetrating in the up-down direction are formed above the corresponding fitting concave portions 70*a*, 72*a* of the screw-fixing portions 70, 72 of the storage tank 10. As shown in FIG. 14A, in a state where the front attaching portions 70, 72 of the storage tank 10 are attached and engaged with the corresponding front attachment-receiving portions 78, 80 of the tank mounting member 48 from above but are not yet moved rearward (the pre-positioning state), front ends 70*c*, 72*c* of the fitting concave portions 70*a*, 72*a* of the screw-fixing portions 70, 72 of the storage tank 10 are separate from front ends 78*c*, 80*c* of the protruding portions 78*a*, 80*a* of the screw-fixing portions 78, 80 of the tank mounting member 48. At this time, as shown in FIG. 14A, a central axis C1 of the upper screw holes 70*b*, 72*b* of the screw-fixing portions 70, 72 of the storage tank 10 is at a position more forward than a central axis C2 of the lower screw holes 78*b*, 80*b* of the screw-fixing portions 78, 80 of the tank mounting member 48, and the upper screw holes 70*b*, 72*b* do not coincide with the corresponding lower screw holes 78*b*, 80*b*.

Then, when the storage tank 10 is moved rearward relative to the tank mounting member 48, the screw-fixing portions 70, 72 of the storage tank 10 in the state shown in FIG. 14A move rearward (in the arrow R direction in FIG. 14A) relative to the corresponding rear attachment-receiving portions 74, 76 of the tank mounting member 48. As shown in FIG. 14B, the front ends 70*c*, 72*c* of the fitting concave portions 70*a*, 72*a* of the screw-fixing portions 70, 72 of the storage tank 10 thus abut against the corresponding front ends 78*c*, 80*c* of the protruding portions 78*a*, 80*a* of the screw-fixing portions 78, 80 of the tank mounting member 48. At this time, as shown in FIG. 14B, the central axis C1 of the upper screw holes 70*b*, 72*b* of the screw-fixing portions 70, 72 of the storage tank 10 coincides with the central axis C2 of the corresponding lower screw holes 78*b*, 80*b* of the screw-fixing portions 78, 80 of the tank mounting member 48, and positioning of the screw-fixing portions 70, 72 of the storage tank 10 and the screw-fixing portions 78, 80 of the tank mounting member 48 is completed. Then, when common screw members 82 (see FIGS. 7 and 9) are fastened into the coinciding upper screw holes 70*b*, 72*b* and lower screw holes 78*b*, 80*b*, the screw-fixing portions 70, 72 of the storage tank 10 are fixed to the screw-fixing portions 78, 80 of the tank mounting member 48.

As a result, as shown in FIGS. 13A to 14B, when the attaching portions 66, 68, 70, 72 of the storage tank 10 and the corresponding attachment-receiving portions 74, 76, 78, 80 of the tank mounting member 48 are attached to each other, two positions are locked, that is, the attaching-side locking portions 66*a*, 68*a* of the rear attaching portions 66, 68 of the storage tank 10 and the corresponding attachment receiving-side locking portions 74*a*, 76*a* of the rear attachment-receiving portions 74, 76 of the tank mounting member 48 are locked, and attaching property of the storage tank 10 to the tank mounting member 48 is improved, and also, positioning of the front attaching portions (screw-fixing portions) 70, 72 of the storage tank 10 fixed by the screw members 82 relative to the corresponding front attaching portions (screw-fixing portions) 78, 80 of the tank mounting member 48 is facilitated. Furthermore, in a state where the attaching portions 66, 68, 70, 72 of the storage tank 10 and the corresponding attachment-receiving portions 74, 76, 78, 80 of the tank mounting member 48 are attached to each other, the bottom surface of the large-tank rear attaching portion 66 of the storage tank 10 is in contact with the bottom surface of the rear attachment-receiving portion 74 of the tank mounting member 48 while a state is maintained in relation to the bottom surface of the small-tank rear attaching portion 68 of the storage tank 10, where the bottom surface is not in contact with the bottom surface of the rear attachment-receiving portion 76 of the tank mounting member 48 positioned below the aforementioned bottom surface and the gap G0 is formed. Accordingly, compared with a structure where the bottom surface of the small-tank rear attaching portion 68 of the storage tank 10 is fixed by being in contact with the bottom surface of the rear attachment-receiving portion 76 of the tank mounting member 48 positioned below the aforementioned bottom surface, the storage tank 10 may be prevented from being fixed to the tank mounting member 48 in an excessively twisted state, and also, from a long-term perspective, strength of the storage tank 10 may be prevented from becoming low. Furthermore, in relation to the storage tank 10 that is in the state of being attached to the tank mounting member 48, the position of the center of gravity O (see FIGS. 4, 8 and 9) of the storage tank 10 in the full-water state is shifted to an asymmetrical position in each of the up-down direction, the front-back direction, and the left-right direction of the storage tank 10, and even when the storage tank 10 is tilted toward the large tank section 44 with a greater capacity, there is no gap between the bottom surface of the large-tank rear attaching portion 66 of the storage tank 10 and the bottom surface of the rear attachment-receiving portion 74 of the tank mounting member 48 (or the gap is smaller than on the small-tank rear attaching portion 68 side), and the bottom surface of the large-tank rear attaching portion 66 of the storage tank 10 is landed (or is capable of swiftly landing). The amount of deformation when the storage tank 10 tilts may thus be made small.

Furthermore, as shown in FIGS. 3 to 5 and FIGS. 7 to 9, a single supported hole 84 and a pair of supported projections 86, 86 as supported portions to be supported by the pump P as the deformation-preventing supporting member are provided at the top tank member T1 of the storage tank 10 but not at the bottom tank member T2. Specifically, the single supported hole 84 of the top tank member T1 of the storage tank 10 is formed horizontally penetrating the inner side wall surface 44*c* of the large tank section 44 of the storage tank 10 in the left-right direction of the toilet main body 2, and the upstream end 36*a* of the pump connecting pipe 36 of the pump P is connected thereto. The upstream end 36*a* of the pump connecting pipe 36 of the pump P is thereby made a first supporting portion where the supported hole 84 of the storage tank 10 is fixed. Here, as shown in FIGS. 3 to 5 and FIGS. 7 to 9, the supported hole 84 among the supported hole 84 and the supported projections 86, 86 as the supported portions of the storage tank 10 is formed in the concave region I of the storage tank 10. As shown in FIGS. 3 and 4, the pump P includes a pair of supporting members 88, 88 provided on one end side of the pump main body 30 in the left-right direction (on the left side when the toilet main body 2 is seen from the front) and protruding outward in an axial direction, and fixing screws 90, 90 attached to respective ones of the supporting members 88, 88. The pair of supported projections 86, 86 of the top tank member T1 of the storage tank 10 are thus fixed to the pair of supporting members 88, 88 of the pump P by the fixing screws 90, 90. That is, the pair of supporting members 88, 88 and the fixing screws 90, 90 of the pump P are second supporting portions for fixing the pair of supported projections 86, 86 of the storage tank 10. Moreover, the upstream end 36*a* of the pump connecting pipe 36 of the pump P connected to the supported hole 84 of the storage tank 10 and at least a part of the pump main body 30 of the pump P fixed to the pair of supported projections 86, 86 of the storage tank 10 are capable of supporting the storage tank 10 at between the large tank section 44 and the small tank section 46 while being disposed in the concave region I of the storage tank 10, and are capable of preventing deformation of the storage tank 10 (especially, deformation of the concave region I).

Furthermore, as shown in FIGS. 4 and 9, the supported hole 84 and the supported projections 86, 86 of the storage tank 10 are formed at positions not coinciding with the position of the center of gravity O of the storage tank in the full-water state. More specifically, as shown in FIGS. 4 and 9, the supported hole 84 of the storage tank 10 is positioned more to the right and rear and higher than the position of the center of gravity O of the storage tank seen from the front side of the toilet main body 2. In contrast, each of the supported projections 86, 86 of the storage tank 10 is, as shown in FIGS. 4 and 9, positioned more to the left and front/rear and higher than the position of the center of gravity O of the storage tank seen from the front side of the toilet main body 2. Accordingly, the first supporting portion (the upstream end 36*a* of the pump connecting pipe 36) and the second supporting portions (the supporting members 88, 88 and the fixing screws 90, 90) of the pump P described above are positioned in respective regions on either side of the position of the center of gravity O of the storage tank 10 in the front-back and left-right directions, in a manner surrounding the center of gravity O of the storage tank 10.

Additionally, the pump connecting pipe 36 of the pump P as the deformation-preventing supporting member is formed from a material having higher rigidity than a flexible hose member. Moreover, the upstream end 36*a* of the pump connecting pipe 36 is directly fixed to the supported hole 84 of the storage tank 10.

Next, as shown in FIGS. 7 to 9, an approximately cylindrical rubber bushing B as an antivibration member is provided on a bottom surface of the base plate 50, at each position to be fixed by the plurality of (four) screws 54 from above. The storage tank 10 is thus fixed to the toilet main body 2 via the base plate 50 and the rubber bushings B.

Next, effects of the flush toilet 1 according to the first embodiment of the present invention described above will be described with reference to FIGS. 1 to 14B. First, with the flush toilet 1 according to the first embodiment of the present invention, because the shape of the storage tank 10 is made asymmetrical in the up-down, front-back and left-right directions by the large tank section 44 and the small tank section 46, in a state where the storage tank 10 of the tank device 4 is installed behind the toilet main body 2 and above the floor surface F, the storage tank 10 is easily deformable due to the weight of the flush water stored in the storage tank 10. However, in the present embodiment, the pump P that is the deformation-preventing supporting member provided on the storage tank 10 may prevent deformation of the storage tank 10 while supporting the storage tank 10 that is installed on the toilet main body 2. Accordingly, for example, even when the storage tank 10 itself includes joining portions (the lower-edge joining portion 10*b* of the top tank member T1, the upper-edge joining portion 10*c* of the bottom tank member T2) to be joined in a watertight manner in a state where the storage tank is installed on the toilet main body 2, or a connection element (the water receiving housing 24) to be connected to the storage tank 10 in a watertight manner is included, leakage of flush water in the storage tank 10 that is caused by deformation of the joining portions (the lower-edge joining portion 10*b* of the top tank member T1, the upper-edge joining portion 10*c* of the bottom tank member T2) of the storage tank 10 or a connection part to the connection element (the water receiving housing 24 or the like) may be prevented. As a result, reliability of the tank device 4 may be secured.

Furthermore, with the flush toilet 1 according to the present embodiment, the storage tank 10 that is installed on the toilet main body 2 is placed in a state where deformation is easily caused due to the balance being unstable around the center of gravity O due to the shape of the storage tank 10 being asymmetrical in the up-down, front-back and left-right directions. However, because the supported portions (the supported hole 84, the supported projections 86) of the storage tank 10 are at positions not coinciding with the position of the center of gravity O of the storage tank 10, and are supported by the pump P as the deformation-preventing supporting member (the upstream end 36*a* of the pump connecting pipe 36, the supporting members 88, the fixing screws 90), deformation of the storage tank 10 may be effectively prevented.

Furthermore, with the flush toilet 1 according to the present embodiment, the first supporting portion (the upstream end 36*a* of the pump connecting pipe 36) and the second supporting portions (the supporting members 88, the fixing screws 90) of the deformation-preventing supporting member (the pump P) may fix a first supported portion (the supported hole 84) and second supported portions (the supported projections 86) of the storage tank 10 positioned on either side of the position of the center of gravity O of the storage tank 10 in the front-back and left-right directions. Accordingly, even in a case where deformation is easily caused due to the balance of the storage tank 10 that is installed on the toilet main body 2 being unstable around the center of gravity O due to the shape of the storage tank 10 being asymmetrical in the up-down, front-back and left-right directions, deformation of the storage tank 10 may be more effectively prevented.

Furthermore, with the flush toilet 1 according to the present embodiment, due to the demand to reduce the size while maintaining an amount of flush water to be stored, the storage tank 10 to be installed in a limited space behind the toilet main body 2 has a shape that is asymmetrical in the up-down, front-back and left-right directions. Furthermore, particularly, the concave region I of the storage tank 10 that is formed into a concave shape by being surrounded by the inner side wall surfaces 44*c*, 46*c* of the large tank section 44 and the small tank section 46 of the storage tank 10 complicates the shape of the storage tank 10, and is also easily deformed in a state where the storage tank 10 is installed on the toilet main body 2. Accordingly, in the present embodiment, deformation of the concave region I of the storage tank 10 that has a complex shape and that is easily deformed may be effectively prevented by supporting the supported portions (the supported hole 84 and the supported projections 86) of the storage tank 10 by the deformation-preventing supporting member (the pump P). As a result, reduction in size may be achieved while securing a great capacity in relation to the storage tank 10. Furthermore, water leakage from the storage tank 10 may be prevented, and reliability of the tank device 4 may be secured.

Furthermore, with the flush toilet 1 according to the present embodiment, of the supported hole 84 and the supported projections 86, 86 as the supported portions of the storage tank 10, the supported hole 84 may be formed in the concave region I of the storage tank 10. Moreover, the upstream end 36*a* of the pump connecting pipe 36 of the pump P connected to the supported hole 84 of the storage tank 10 and at least a part of the pump main body 30 of the pump P fixed to the pair of supported projections 86, 86 of the storage tank 10 are capable of supporting the storage tank 10 at between the large tank section 44 and the small tank section 46 while being disposed in the concave region I of the storage tank 10. Accordingly, deformation of the storage tank 10 that is installed on the toilet main body 2 (especially, deformation of the concave region I of the storage tank 10) may be efficiently prevented, and also, reduction in size may be achieved while securing a great capacity in relation to the storage tank 10. As a result, the size of the entire tank device 4 may be reduced while securing reliability of the tank device 4, and also, the size of the entire flush toilet 1 may be reduced.

Furthermore, with the flush toilet 1 according to the present embodiment, the pump P of the tank device 4 for feeding, under pressure, the flush water in the storage tank 10 to the toilet main body 2 may also be used as the deformation-preventing supporting member, and thus, a deformation-preventing supporting member other than the pump P does not have to be provided, and the size of the entire tank device 4 may be reduced. Accordingly, the size of the entire flush toilet 1 may also be reduced.

Furthermore, the pump P that feeds, under pressure, the flush water in the storage tank 10 to the toilet main body 2 generally causes vibration at the time of operation, and thus, with the flush toilet 1 according to the present embodiment, an antivibration member or the like is desirably provided at a fixing part between the pump P and the storage tank 10 at the time of fixing the pump P to the storage tank 10. However, in the case where an antivibration member or the like is provided at the fixing part between the pump P and the storage tank 10, the pump P is possibly prevented from functioning as the deformation-preventing supporting member by being obstructed by the antivibration member or the like at the time of the storage tank 10 that is installed on the toilet main body 2 deforming under the weight of the flush water inside the storage tank 10 or the like. However, in the present embodiment, the upstream end 36*a* of the pump connecting pipe 36 of the pump P is directly fixed to the supported hole 84 of the storage tank 10. For its part, the storage tank 10 is fixed to the toilet main body 2 via the antivibration members (the rubber bushings B) and the base plate 50 of the tank mounting member 48. Accordingly, transmission, between the tank device 4 and the toilet main body 2, of vibration caused by the pump P may be effectively prevented by the antivibration members (the rubber bushings B) and the base plate 50 of the tank mounting member 48 between the storage tank 10 and the toilet main body 2, while preventing deformation of the storage tank 10 that is installed on the toilet main body 2.

Furthermore, with the flush toilet 1 according to the present embodiment, for example, if a flexible hose member is used as the pump connecting pipe 36 for connecting the pump chamber 30*a* of the pump P and the storage tank 10, a winding space that takes into account flexibility of the hose member becomes necessary around the pump P and the storage tank 10. However, in the present embodiment, the pump connecting pipe 36 is formed from a material having higher rigidity than a flexible hose member, and thus, a space around the pump P and the storage tank 10 for winding the pump connecting pipe 36 becomes unnecessary. Accordingly, the tank capacity of the storage tank 10 may be increased to that extent, and also, the size of the entire tank device 4 may be reduced. Furthermore, the size of the entire flush toilet 1 may also be reduced. Furthermore, because the pump connecting pipe 36 of the pump P has higher rigidity than a flexible hose member, vibration, deformation (elastic deformation such as bending, twisting, and warping) and the like of the pump connecting pipe 36 itself at the time of operation of the pump P may also be prevented. Accordingly, deformation of the storage tank 10 that is installed on the toilet main body 2 may be prevented without separately providing a deformation-preventing supporting member other than the pump P. Moreover, the pump connecting pipe 36 of the pump P extends in the left-right direction of the storage tank 10 from the pump chamber 30*a* toward the upstream side, and the upstream end 36*a* of the pump connecting pipe 36 is connected to the supported hole 84 of the storage tank 10. A forward protruding dimension of the tank device 4 may thus be reduced, and a forward protruding dimension of the entire flush toilet 1 may also be reduced. As a result, the size of the entire tank device 4 and the entire flush toilet 1 may be reduced while securing a large capacity in relation to the storage tank 10.

Furthermore, with the flush toilet 1 according to the present embodiment, the discharge trap pipe 2*b* of the toilet main body 2 extends in the front-back direction, in a plan view, from the inlet 2*h* connected to the bowl 2*a* to the outlet 2*i* behind the bowl 2*a*. The storage tank 10 may be disposed to surround the upper part of the discharge trap pipe 2*b* of the toilet main body 2 from both left and right sides and from the rear side (see FIGS. 4, 8 and 9). Accordingly, the storage tank 10 and the pump P may be efficiently disposed next to each other by effectively using the limited space around the upper part of the discharge trap pipe 2*b* behind the toilet main body 2. Accordingly, the forward protruding dimension of the tank device 4 may be reduced and the forward protruding dimension of the entire flush toilet 1 may also be reduced, and the size of the entire flush toilet 1 may be reduced while increasing the capacity of the storage tank 10.

Furthermore, with the flush toilet 1 according to the present embodiment, in relation to the supported portions (the supported hole 84, the supported projections 86) of the storage tank 10 to be supported by the deformation-preventing supporting member (the pump P), a greater number of supported portions may be provided by being provided at the top tank section (the top tank member T1) of the top tank section (the top tank member T) and the bottom tank section (the bottom tank member T2) of the storage tank 10 that are joined to each other in the up-down direction, instead of at the bottom tank section (the bottom tank member T2). Accordingly, the supported portions (the supported hole 84, the supported projections 86) of the storage tank 10 to be supported by the deformation-preventing supporting member (the pump P) may be concentrated on the top tank section (the top tank member T1) of the storage tank 10 as much as possible. Therefore, when the supported portions (the supported hole 84, the supported projections 86) of the storage tank 10 are supported by the deformation-preventing supporting member (the pump P) after the storage tank 10 is assembled to the toilet main body 2, deformation of the top tank section (the top tank member T1) of the storage tank 10 may be especially effectively prevented. Accordingly, deformation of the bottom tank section (the bottom tank member T2) joined to the top tank section (the top tank member T1) of the storage tank 10 may also be effectively prevented, and deformation of the entire storage tank 10 may be effectively prevented. Furthermore, the bottom tank section (the bottom tank member T2) may stably support the weight of the flush water from below regardless of the amount of flush water in the storage tank 10, and is thus less likely to be deformed compared to the top tank section (the top tank member T1). In contrast, because the position of the center of gravity O of the storage tank 10 changes depending on the amount of flush water in the storage tank 10, the top tank section (the top tank member T1) is more easily affected by the change in the position of the center of gravity O of the storage tank 10 than the bottom tank section (the bottom tank member T2), and is more easily deformed. Accordingly, because the storage tank 10 may be stably supported by the deformation-preventing supporting member (the pump P) when a greater number of supported portions (the supported hole 84, the supported projections 86) of the storage tank 10 are provided at the top tank section (the top tank member T1) than at the bottom tank section (the bottom tank member T2), deformation of the storage tank 10 may be more effectively prevented. Furthermore, when a greater number of supported portions (the supported hole 84, the supported projections 86) of the storage tank 10 are provided at the top tank section (the top tank member T1) than at the bottom tank section (the bottom tank member T2), a space below the bottom tank section (the bottom tank member T2) may be effectively used, and the size of the entire flush toilet 1 may be reduced, and a low silhouette may be achieved.

Figure 15:
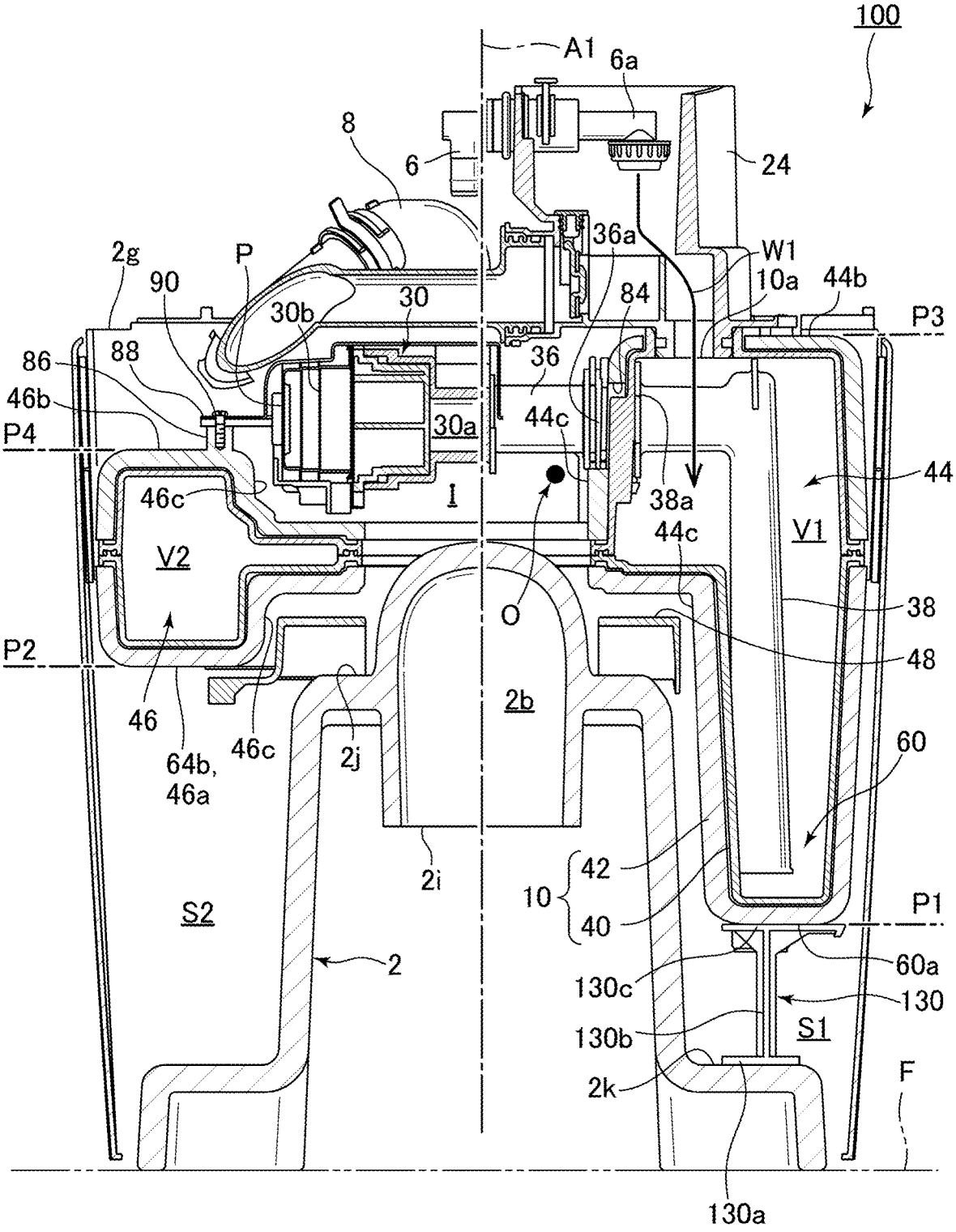
FIG. 15 is a cross-sectional front view, as shown in FIG. 4, of a flush toilet according to a second embodiment of the present invention.

Next, a description will be given of a flush toilet according to a second embodiment of the present invention with reference to FIG. 15. FIG. 15 is a cross-sectional front view, as shown in FIG. 4, of the flush toilet according to the second embodiment of the present invention. Here, parts of a flush toilet 100 according to the second embodiment of the present invention shown in FIG. 15 that are same as those of the flush toilet 1 according to the first embodiment of the present invention shown in FIG. 4 will be denoted by same reference signs, and a description thereof will be omitted. As shown in FIG. 15, as the deformation-preventing supporting member for preventing deformation of the storage tank 10 by supporting the storage tank 10 that is installed on the toilet main body 2, the flush toilet 100 according to the second embodiment of the present invention includes, in addition to the pump P of the flush toilet 1 according to the first embodiment described above, a supporting member 130 for supporting a supported portion (the bottom surface 60*a* of the lower large tank section 60) of the storage tank 10 from below. That is, the supporting member 130 as the deformation-preventing supporting member is provided in a space between a base surface 2*k* provided at a lower part on one of left and right sides (on the right side seen from the front side of the toilet main body 2 in FIG. 15) of the toilet main body 2 and the bottom surface 60*a* of the lower large tank section 60 of the storage tank 10. More specifically, the supporting member 130 includes a supporting foot portion 130*a* at a bottom that is installed on the base surface 2*k* of the toilet main body 2, a supporting leg portion 130*b* extending upward from the supporting foot portion 130*a*, and a support receiving portion 130*c* for supporting the bottom surface 60*a* of the lower large tank section 60 of the storage tank 10 from below, the support receiving portion 130*c* being provided at an upper end of the supporting leg portion 130*b*. The bottom surface 60*a* of the lower large tank section 60 of the storage tank 10 that is installed on the toilet main body 2 is supported from below by each of the portions 130*a*, 130*b*, 130*c* of the supporting member 130, and deformation of the storage tank 10 is thereby prevented.

With the flush toilet 100 according to the second embodiment of the present invention described above, the supporting member 130 provided in the space between the base surface 2*k* of the toilet main body 2 and the bottom surface 60*a* of the lower large tank section 60 of the storage tank 10 may prevent deformation of the storage tank 10 by supporting, from below, the storage tank 10 that is installed on the toilet main body 2, independently of the pump P as the deformation-preventing supporting member. Deformation of the entire storage tank 10 may thus be more effectively prevented.

Figure 16:
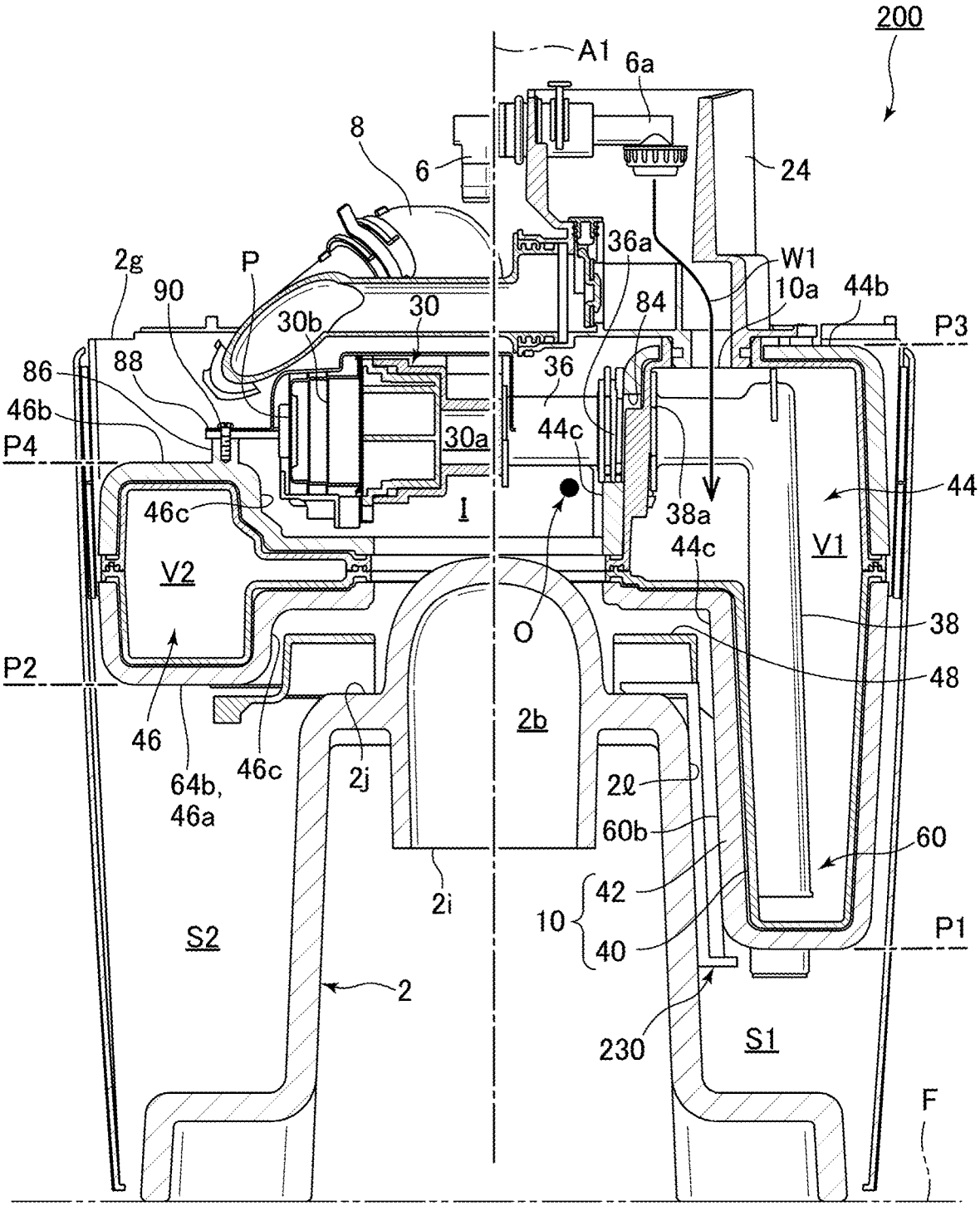
FIG. 16 is a cross-sectional front view, as shown in FIG. 4, of a flush toilet according to a third embodiment of the present invention.

Next, a description will be given of a flush toilet according to a third embodiment of the present invention with reference to FIG. 16. FIG. 16 is a cross-sectional front view, as shown in FIG. 4, of the flush toilet according to the third embodiment of the present invention. Here, parts of a flush toilet 200 according to the third embodiment of the present invention shown in FIG. 16 that are same as those of the flush toilet 1 according to the first embodiment of the present invention shown in FIG. 4 will be denoted by same reference signs, and a description thereof will be omitted. As shown in FIG. 16, as the deformation-preventing supporting member for preventing deformation of the storage tank 10 by supporting the storage tank 10 that is installed on the toilet main body 2, the flush toilet 200 according to the third embodiment of the present invention includes, in addition to the pump P of the flush toilet 1 according to the first embodiment described above, a supporting member 230 for supporting a supported portion (an inner side wall surface 60*b* of the lower large tank section 60) of the storage tank 10 from an inner side. That is, the supporting member 230 as the deformation-preventing supporting member is provided in a space between a rear outer wall surface 2*l* provided on one of the left and right sides (on the right side seen from the front side of the toilet main body 2 in FIG. 16) of the discharge trap pipe 2*b* of the toilet main body 2 and the inner side wall surface 60*b* of the lower large tank section 60 of the storage tank 10 while extending in the up-down direction to be disposed on a part of the tank mounting member 48.

With the flush toilet 200 according to the third embodiment of the present invention described above, the supporting member 230 of the tank mounting member 48 provided in the space between the rear outer wall surface 2*l* of the toilet main body 2 and the inner side wall surface 60*b* of the lower large tank section 60 of the storage tank 10 may prevent deformation of the storage tank 10 by supporting, from an inner side, the storage tank 10 that is installed on the toilet main body 2, independently of the pump P as the deformation-preventing supporting member. Deformation of the entire storage tank 10 may thus be more effectively prevented.

Figure 17:
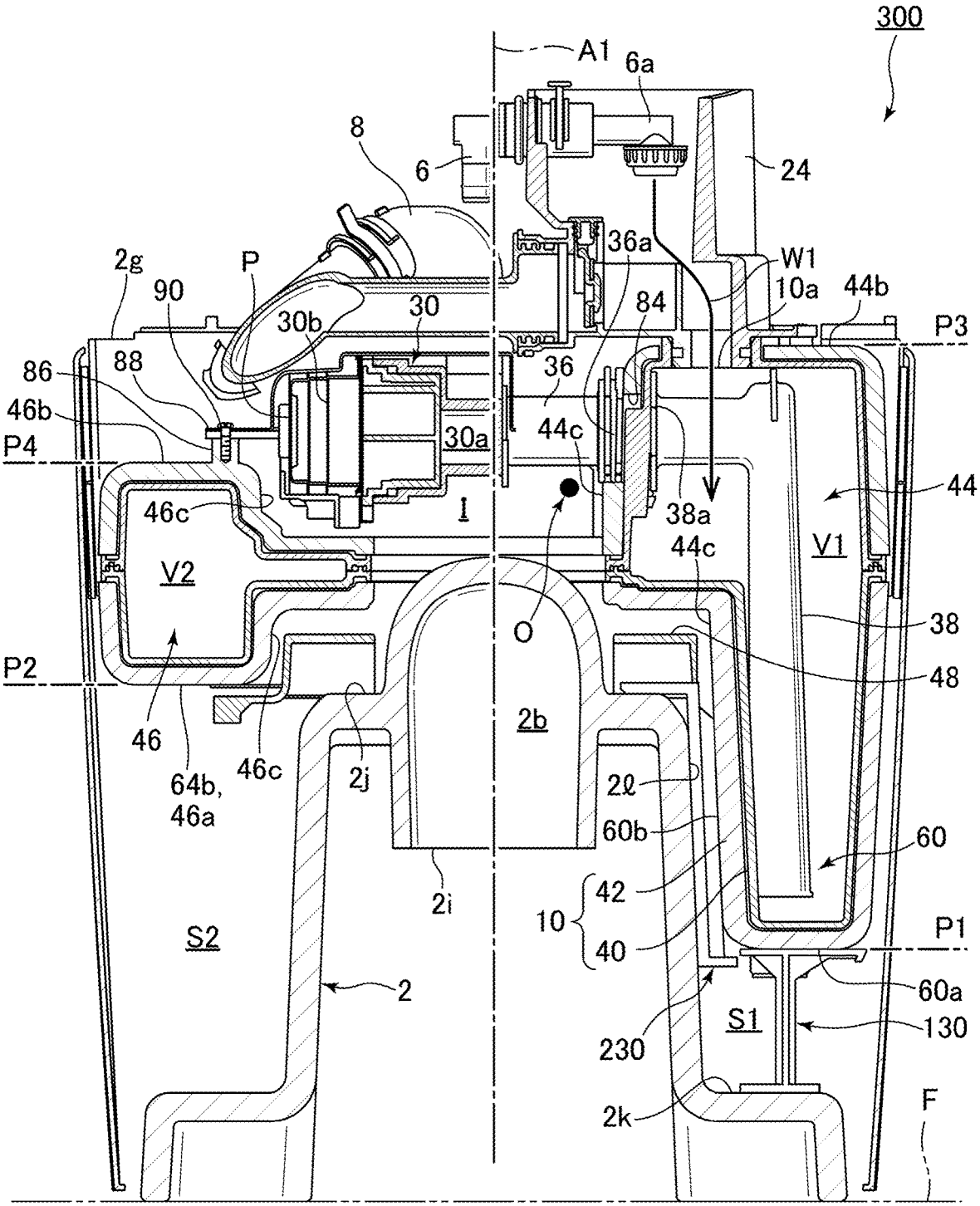
FIG. 17 is a cross-sectional front view, as shown in FIG. 4, of a flush toilet according to a fourth embodiment of the present invention.

Next, a description will be given of a flush toilet according to a fourth embodiment of the present invention with reference to FIG. 17. FIG. 17 is a cross-sectional front view, as shown in FIG. 4, of the flush toilet according to the fourth embodiment of the present invention. Here, parts of a flush toilet 300 according to the fourth embodiment of the present invention shown in FIG. 17 that are same as those of the flush toilets 1, 100, 200 according to the first to third embodiments of the present invention shown in FIGS. 4, 15 and 16 will be denoted by same reference signs, and a description thereof will be omitted. As shown in FIG. 17, as the deformation-preventing supporting member for preventing deformation of the storage tank 10 by supporting the storage tank 10 that is installed on the toilet main body 2, the flush toilet 300 according to the fourth embodiment of the present invention includes all of the pump P and the supporting members 130, 230 of the flush toilets 1, 100, 200 according to the first to third embodiments described above. Accordingly, the supported portions (the supported hole 84, the supported projections 86) of the storage tank 10 that is installed on the toilet main body 2 may be supported by the pump P to prevent deformation of the storage tank 10, and also, the bottom surface 60*a* and the inner side wall surface 60*b* of the lower large tank section 60, that are other supported portions of the storage tank 10, may be supported by the supporting members 130, 230, and deformation of the entire storage tank 10 may be more effectively prevented.

Additionally, in relation to the flush toilets 1, 100, 200, 300 according to the first to fourth embodiments of the present invention described above, a mode is described where the shape of the storage tank 10 is made asymmetrical in the up-down, front-back and left-right directions by the large tank section 44 and the small tank section 46, but it suffices if the shape is made asymmetrical in one of the front-back and left-right directions by the large tank section 44 and the small tank section 46.

Furthermore, in relation to the flush toilets 1, 100, 200, 300 according to the first to fourth embodiments of the present invention described above, a mode is especially described where the pump P is used as one of the deformation-preventing supporting members for preventing deformation of the concave region I of the top tank member T1 of the storage tank 10 that is installed on the toilet main body 2. However, as another mode, a supporting member different from the pump P may be provided as the deformation-preventing supporting member, the supporting member being provided extending in the left-right direction in the concave region I between the large tank section 44 and the small tank section 46 of the top tank member T1 of the storage tank 10. Deformation of the concave region I of the top tank member T1 of the storage tank 10 that is installed on the toilet main body 2 may thereby be more effectively prevented.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet for discharging waste with flush water, the flush toilet comprising:

a toilet main body including a bowl configured to receive waste, and a discharge trap configured to discharge the waste in the bowl; and a tank device configured to supply the flush water to the toilet main body, wherein the tank device includes a storage tank configured to store the flush water to be supplied to the toilet main body, the storage tank being provided behind the toilet main body and above a floor surface, the storage tank has a shape that is asymmetrical in a front-back or left-right direction and includes a large tank section and a small tank section, the large tank section being a large-capacity side of the storage tank that is divided into two at a center in the left-right direction when seen in the front-back direction, the small tank section being a small-capacity side of the storage tank that is divided into two at the center in the left-right direction when seen in the front-back direction, and the storage tank or the toilet main body includes a deformation-preventing supporting member configured to prevent deformation of the storage tank by supporting the storage tank that is installed on the toilet main body, wherein the tank device further includes a pump configured to feed, under pressure, the flush water in the storage tank to the toilet main body, the pump being provided as the deformation-preventing supporting member.

2. The flush toilet according to claim 1, wherein the storage tank includes a supported portion configured to be supported by the deformation-preventing supporting member, the supported portion being positioned at a position not coinciding with a position of a center of gravity of the storage tank.

3. The flush toilet according to claim 2, wherein the supported portion of the storage tank includes a first supported portion and a second supported portion positioned on either side of the position of the center of gravity of the storage tank in the front-back direction or the left-right direction, and the deformation-preventing supporting member includes a first supporting portion and a second supporting portion configured to be fixed to the first supported portion and the second supported portion, respectively, the first supporting portion and the second supporting portion being positioned on the either side of the position of the center of gravity of the storage tank in the front-back direction or the left-right direction.

4. The flush toilet according to claim 2, wherein the storage tank includes a concave region formed into a concave shape by being surrounded by an inner side wall surface of each of the large tank section and the small tank section, and the deformation-preventing supporting member supports the supported portion to prevent deformation of the concave region of the storage tank.

5. The flush toilet according to claim 4, wherein at least a part of the supported portion is disposed in the concave region of the storage tank, and the deformation-preventing supporting member supports the supported portion while being at least partially disposed in the concave region of the storage tank.

6. The flush toilet according to claim 1, further comprising an antivibration member provided between the storage tank and the toilet main body, wherein the pump is directly fixed to the storage tank, and the storage tank is fixed to the toilet main body via the antivibration member.

7. The flush toilet according to claim 1, wherein the pump includes a pump chamber including an impeller, and a connecting pipe extending in the left-right direction of the storage tank from the pump chamber toward an upstream side to be connected to the storage tank, the connecting pipe being formed, as the deformation-preventing supporting member, from a material having higher rigidity than a flexible hose member.

8. The flush toilet according to claim 1, wherein the discharge trap of the toilet main body extends in the front-back direction in a plan view, from an inlet connected to the bowl to an outlet behind the bowl, and the storage tank is disposed to surround an upper part of the discharge trap from both left and right sides and from a rear side.

9. The flush toilet according to claim 1, wherein the storage tank includes a top tank section and a bottom tank section configured to be joined to each other in an up-down direction, and supported portions configured to be supported by the deformation-preventing supporting member is provided at least at the top tank section of the top tank section and the bottom tank section, where a greater number of supported portions are provided at the top tank section than at the bottom tank section.

* * * * *